US008888236B2

(12) United States Patent
Kobayashi

(10) Patent No.: US 8,888,236 B2
(45) Date of Patent: Nov. 18, 2014

(54) INK-JET RECORDING APPARATUS

(71) Applicant: Isao Kobayashi, Nagoya (JP)

(72) Inventor: Isao Kobayashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/039,877

(22) Filed: Sep. 27, 2013

(65) Prior Publication Data

US 2014/0176642 A1 Jun. 26, 2014

(30) Foreign Application Priority Data

Dec. 26, 2012 (JP) ..... 2012-283340

(51) Int. Cl.
*B41J 2/165* (2006.01)
*B41J 23/00* (2006.01)

(52) U.S. Cl.
CPC ..... *B41J 2/16526* (2013.01)
USPC ..... 347/35; 347/23; 347/32; 347/34; 347/36; 347/37

(58) Field of Classification Search
CPC ..... B41J 2/16523; B41J 2/16526
USPC ..... 347/23, 32, 34–37
See application file for complete search history.

(56) References Cited

U.S. PATENT DOCUMENTS

| | | | | |
|---|---|---|---|---|
| 5,896,143 | A * | 4/1999 | Matsui et al. | 347/24 |
| 2001/0020962 | A1 | 9/2001 | Kanaya et al. | |
| 2003/0020769 | A1 * | 1/2003 | Sarmast | 347/7 |
| 2009/0141073 | A1 * | 6/2009 | Umeda | 347/30 |

FOREIGN PATENT DOCUMENTS

| | | | |
|---|---|---|---|
| JP | 2000-280488 | A | 10/2000 |
| JP | 2007-152585 | A | 6/2007 |

* cited by examiner

*Primary Examiner* — Jason Uhlenhake
(74) *Attorney, Agent, or Firm* — Scully, Scott, Murphy & Presser, PC

(57) ABSTRACT

An ink jet recording apparatus includes: a carriage which is movable in a forward direction from one end to the other end; a recording head provided in the carriage and having a plurality of nozzle groups from which the ink is discharged; an ink receiver provided at a side of the one end including a flushing position and configured to receive the ink discharged by a flushing operation; and a controller configured to control operations of the carriage and the recording head. In a case that the carriage is moved in the forward direction, the controller executes: an acceleration process for accelerating the carriage; a selecting process for selecting at least one nozzle group for which the flushing operation is performed; a flushing process for performing the flushing operation for the nozzle group selected in the selecting process during the acceleration process; and a recording process for recording the image.

8 Claims, 19 Drawing Sheets

INK-JET RECORDING APPARATUS

CROSS REFERENCE TO RELATED APPLICATION

The present application claims priority from Japanese Patent Application No. 2012-283340, filed on Dec. 26, 2012, the disclosure of which is incorporated herein by reference in its entirety.

BACKGROUND OF THE INVENTION

1. Field of the Invention

The present invention relates to an ink-jet recording apparatus.

2. Description of the Related Art

There has conventionally been an ink-jet recording apparatus in which a flushing operation is performed by a recording head in a flushing area. The flushing area is positioned outside a recording area in which an image is recorded on a sheet, and further an ink receiving section is arranged in the flushing area. The flushing operation is an operation in which an ink is discharged from nozzles to the ink receiving section in a state that the recording head is positioned in the flushing area. Also, there has been an ink-jet recording apparatus in which the flushing operation is performed during a process of accelerating or speeding up a carriage having the recording head to a recording velocity. In this ink-jet recording apparatus, because of performing the flushing operation during the process of accelerating the carriage to the recording velocity, it is possible to suppress the decline of throughput of image recording.

SUMMARY OF THE INVENTION

However, in a case that the flushing operation is performed during the process of accelerating the carriage as described above and that acceleration of the carriage is great, there is a possibility that a part of the ink discharged from the nozzles is not landed in the ink receiving section. This problem is especially conspicuous when the ink receiving section is narrow with downsizing of the ink-jet recording apparatus.

The present teaching has been made taking the foregoing circumstances into consideration, an object of which is to provide an ink-jet recording apparatus which allows ink discharged from nozzles to reliably land in an ink receiving section while suppressing a decline of throughput of image recording.

According to an aspect of the present teaching, there is provided an ink-jet recording apparatus including: a carriage configured to be movable, within a section between one end and the other end separated in a main scanning direction, in a forward direction from the one end to the other end; a recording head which is provided in the carriage and has a plurality of nozzle groups aligned in the main scanning direction from which the ink is discharged; an ink receiver which is provided at a side of the one end including a flushing position and is configured to receive the ink discharged from each of the nozzle groups by a flushing operation in which the ink is discharged irrespective of recording of an image; and a controller configured to control operations of the carriage and the recording head, wherein in a case that the carriage is moved in the forward direction, the controller is configured to execute: an acceleration process for accelerating the carriage to a recording velocity at which the recording of the image is performed in an acceleration section ranging from a stationary position of the carriage to an acceleration completion position positioned on a downstream of the stationary position in the forward direction; a selecting process for selecting at least one nozzle group for which the flushing operation is performed from the plurality of nozzle groups so that the number of nozzle groups selected is decreased as an acceleration of the carriage in the acceleration process is increased; a flushing process for performing the flushing operation for each nozzle group, which is selected in the selecting process, during the acceleration process in a case that each nozzle group arrives at the flushing position; and a recording process for recording the image by discharging the ink from the nozzle groups while the carriage is moved at the recording velocity in a section between the acceleration completion position and the other end.

According to the above configuration, since the flushing process is executed during the acceleration process, it is possible to suppress the decline of throughput in the recording process. However, even when the flushing process is executed during the acceleration process, it is difficult to prevent the decline of throughput in the recording process completely. In view of this, by determining the number of nozzle groups, for which the flushing operations are performed in one flushing process, depending on acceleration of the carriage, the discharged ink can be reliably landed in the ink receiver while maintaining the throughput of the recording process.

In particular, in a case that the acceleration of the carriage in the acceleration process is small, the number of nozzle groups selected in the selecting process is increased to decrease the number of flushing processes. Accordingly, the decline of throughput in the recording process can be suppressed. On the other hand, in a case that the acceleration of the carriage in the acceleration process is great, the number of nozzle groups selected in the selecting process is decreased. Accordingly, the ink discharged in the flushing process can be reliably landed in the ink receiving section.

BRIEF DESCRIPTION OF THE DRAWINGS

FIGS. 8A and 8B are flowcharts of selecting processes in the first embodiment, wherein FIG. 8A shows a two-color selecting process and FIG. 8B shows a one-color selecting process.

FIGS. 10A to 10C are illustrations of relations between the movement velocities of the carriage and positions of nozzle groups and a waste ink tray in the first embodiment, wherein FIG. 10A shows a state in which four nozzle groups are selected in the selecting process, FIG. 10B shows a state in which two nozzle groups are selected in the selecting process, and FIG. 10C shows a state in which one nozzle group is selected in the selecting process.

DESCRIPTION OF THE PREFERRED EMBODIMENTS

Figure 1:
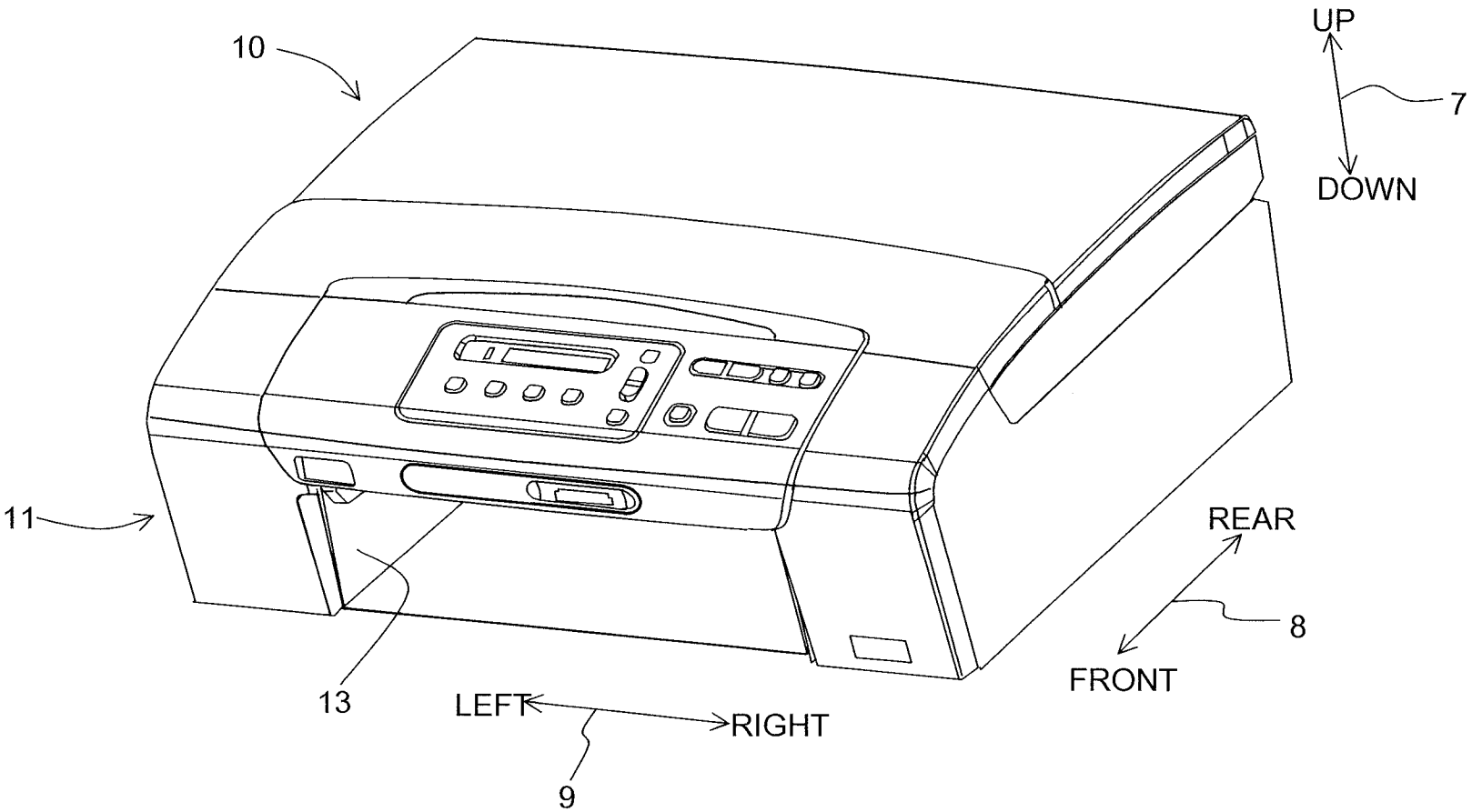
FIG. 1 is a perspective view of a multifunction machine as an exemplary embodiment of the present teaching.

Embodiments of the present teaching will be explained below appropriately with reference to the drawings. The embodiments described below are merely examples of the present teaching. It goes without saying that the embodiments of the present teaching can be appropriately changed within a scope or range without changing the gist or substance of the present teaching. In the following explanation, an up-down direction 7 is defined on the basis of such a state that a multifunction machine 10 is placed to be usable (a state shown in FIG. 1), a front-rear direction 8 is defined upon letting a side on which an opening 13 is provided to be frontward side (front), and a left-right direction 9 is defined upon viewing the multifunction machine 10 from the frontward side (front).

<Entire Structure of the Multifunction Machine 10>

As shown in FIG. 1, the multifunction machine 10 (an example of the ink-jet recording apparatus of the present teaching) has various functions such as a facsimile function and a print function. The multifunction machine 10 according to this embodiment includes a printer section 11 having the print function. The opening 13 is formed in the front surface of the printer section 11 at the front side. A paper feed tray 20 (see FIG. 2) in which recording paper sheet(s) 19 (see FIG. 2) can be accommodated and a paper discharge tray 21 (see FIG. 2) are provided in the printer section 11 so that the paper feed tray 20 and the paper discharge tray 21 can be inserted in and drawn out through the opening 13 in the front-rear direction 8. An object on which an image is recorded by the printer section 11 is not limited to the recording paper sheet 19, and the image may be recorded on a medium having a great bending rigidity such as CD and DVD. The image is recorded on the CD and DVD in a state that the CD or DVD is placed on a media tray in the form of a thin-plate.

<Paper Feed Roller 25>

Figure 2:
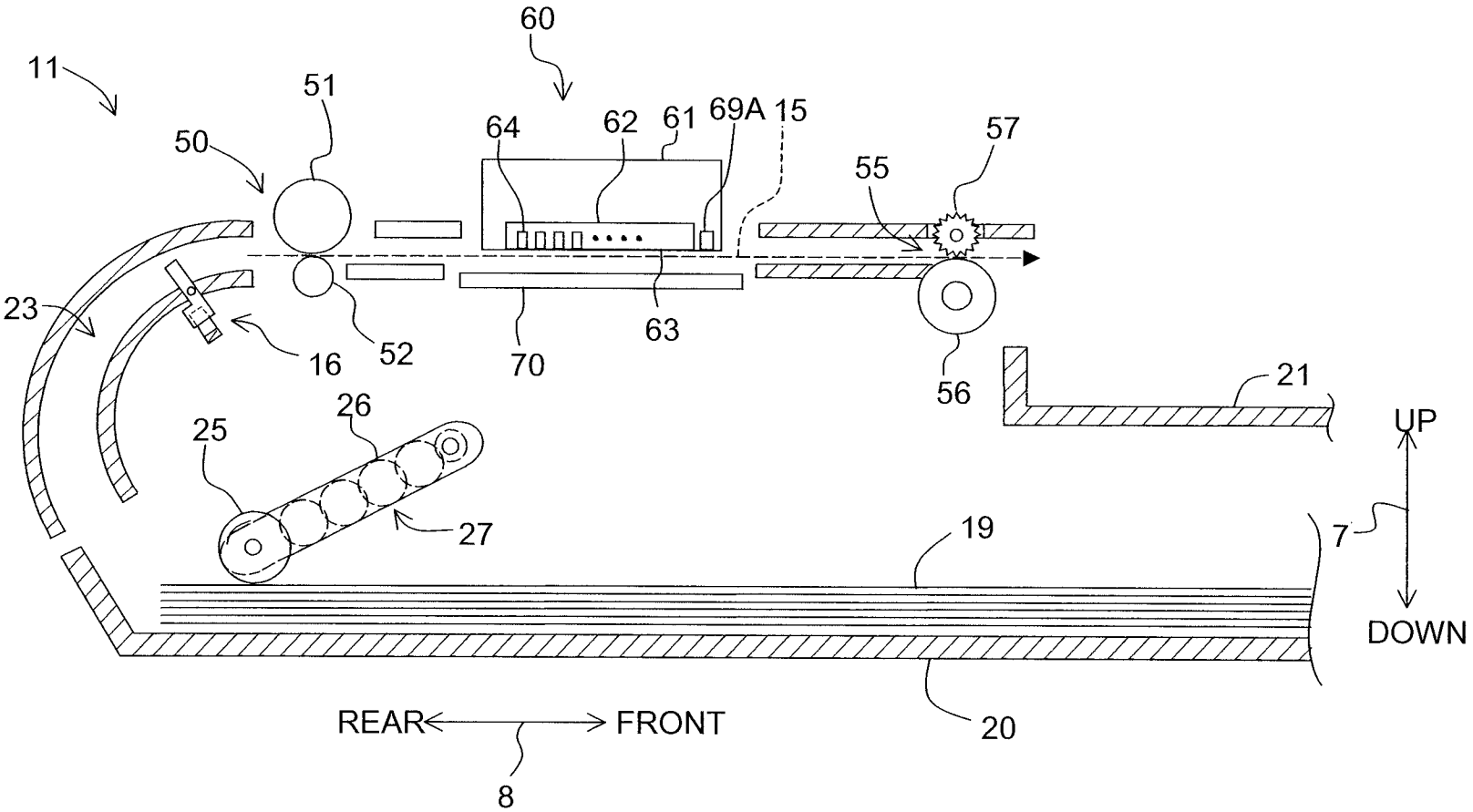
FIG. 2 is a vertical sectional view schematically illustrating an internal structure of a printer section.

As shown in FIG. 2, a paper feed roller 25 is provided over or above the paper feed tray 20 in the printer section 11. The paper feed roller 25 is pivotally supported by an end portion of a paper feed arm 26 which is movable in the up-down direction so that the paper feed arm 26 can be brought in contact with or separate from the paper feed tray 20. The paper feed roller 25 is rotated by the driving force of a transport motor 30 (see FIG. 4) transmitted through a driving transmitting mechanism 27 including a plurality of gears meshed with each other. The recording paper sheet 19 is fed to a transport path 23 by rotating the paper feed roller 25 while being brought in contact under pressure with the recording paper sheet 19 on the paper feed tray 20.

<Transport Path 23>

The transport path 23 is curved upward from the rear end of the paper feed tray 20 to the front side of the printer section 11, and extends out from the rear side (backside) to the front side (foreside) of the printer section 11. A transport roller section 50 and a discharge roller section 55 are provided in the transport path 23. The transport roller section 50 and the discharge roller section 55 nip or sandwich the recording paper sheet 19 and transport the recording paper sheet 19 in a transport direction 15. The transport path 23 includes the sandwiching or nipping position by the transport roller section 50, the upper side of a platen 70 which will be described later, and the nipping position by the discharge roller section 55 to lead to the paper discharge tray 21. The recording paper sheet 19 fed from the paper feed tray 20 is guided to U-turn from the lower side to the upper side on the transport path 23 and arrives at a recording section 60. After the image recording is performed by the recording section 60, the recording paper sheet 19 is discharged on the paper discharge tray 21.

<Transport Roller Section 50>

The transport roller section 50 is provided in the transport path 23 on the upstream side of the recording section 60 in the transport direction 15. The transport roller section 50 includes a transport roller 51 and a pinch roller 52. The transport roller 51 is driven by the transport motor 30 (see FIG. 4). The pinch roller 52 is arranged to face the transport roller 51. The pinch roller 52 rotates with the rotation of the transport roller 51. The recording paper sheet 19 is nipped by the transport roller 51 and the pinch roller 52 and is transported in the transport direction 15.

<Discharge Roller Section 55>

The discharge roller section 55 is provided in the transport path 23 on the downstream side of the recording section 60 in the transport direction 15. The discharge roller section 55 includes a discharge roller 56 and a spur 57. The discharge roller 56 is driven by the transport motor 30. The spur 57 is arranged on the upper side of the transport path 23 to face the discharge roller 56. The spur 57 rotates with the rotation of the discharge roller 56. The recording paper sheet 19 is nipped by the discharge roller 56 and the spur 57 and is transported in the transport direction 15.

<Registration Sensor 160>

As shown in FIG. 2, a well-known registration sensor 160 is provided in the transport path 23 on the upstream side of the transport roller section 50 in the transport direction 15. The registration sensor 160 includes a detecting element (not shown) which is rotatable about an axis and an optical sensor (not shown) provided with a light receiving section and a light emitting section. The light emitted from the light emitting section is blocked in a state that the detecting element is pressed by the recording paper sheet 19 and the like, and thus the light does not reach the light receiving section. In this situation, the optical sensor outputs a low level signal (namely, "signal having a signal level of less than a threshold value") as a sensing signal to the controller 130 as will be described later on. On the other hand, the light emitted from the light emitting section is not blocked in a state that the detecting element is not pressed by the recording paper sheet 19 and the like, and thus the light reaches the light receiving section. In this situation, the optical sensor outputs a high level signal (namely, "signal having a signal level of not less than a threshold value") as the sensing signal to the controller 130.

<Rotary Encoder 165>

Figure 4:
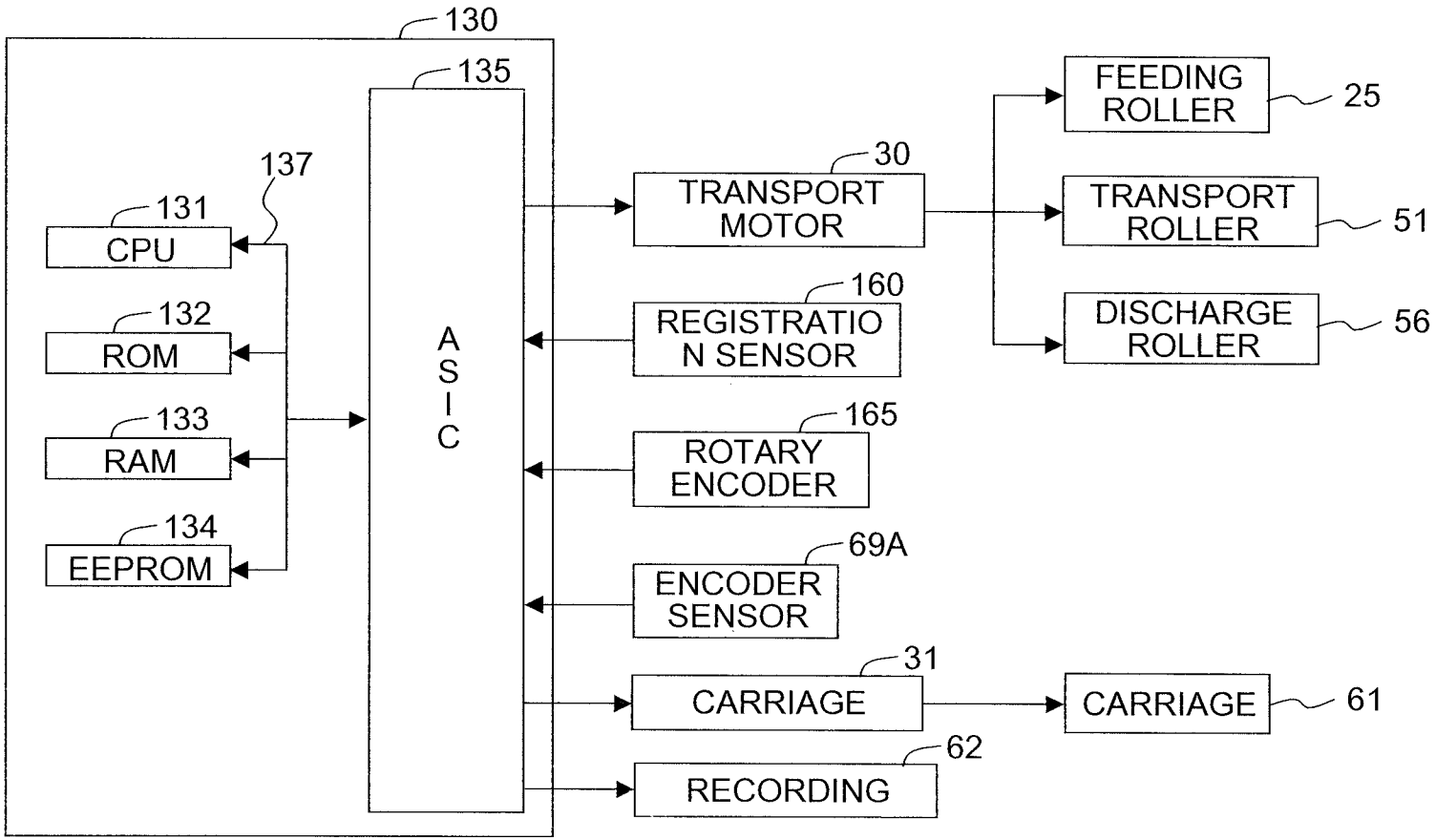
FIG. 4 is a block diagram of a controller provided for the multifunction machine.

As shown in FIG. 4, a well-known rotary encoder 165, which generates a pulse signal with rotation of the transport roller 51, is provided. The rotary encoder 165 includes an encoder disk (not shown) and an optical sensor (not shown). The encoder disk rotates with the rotation of the transport roller 51, and the rotating encoder disk is read by the optical sensor. Accordingly, the optical sensor generates the pulse signal and the generated pulse signal is outputted to the controller 130.

<Recording Section 60>

As shown in FIG. 2, the recording section 60 is provided in the transport path 23 on the downstream side of the transport roller section 50 in the transport direction 15 and on the upstream side of the discharge roller section 55 in the transport direction 15. The recording section 60 records the image in an ink-jet system on the recording paper sheet 19 transported on the transport path 23 in the transport direction 15. The recording section 60 includes the carriage 61, a recording head 62, and an encoder sensor 69A. Further, the platen 70 is arranged at a position facing the recording section 60 (namely, position on a lower side of the transport path 23). The platen 70 extends over the substantially entire region of the transport path 23 in the left-right direction 9 and supports the recording paper sheet 19 transported on the transport path 23.

<Carriage 61>

Figure 3:
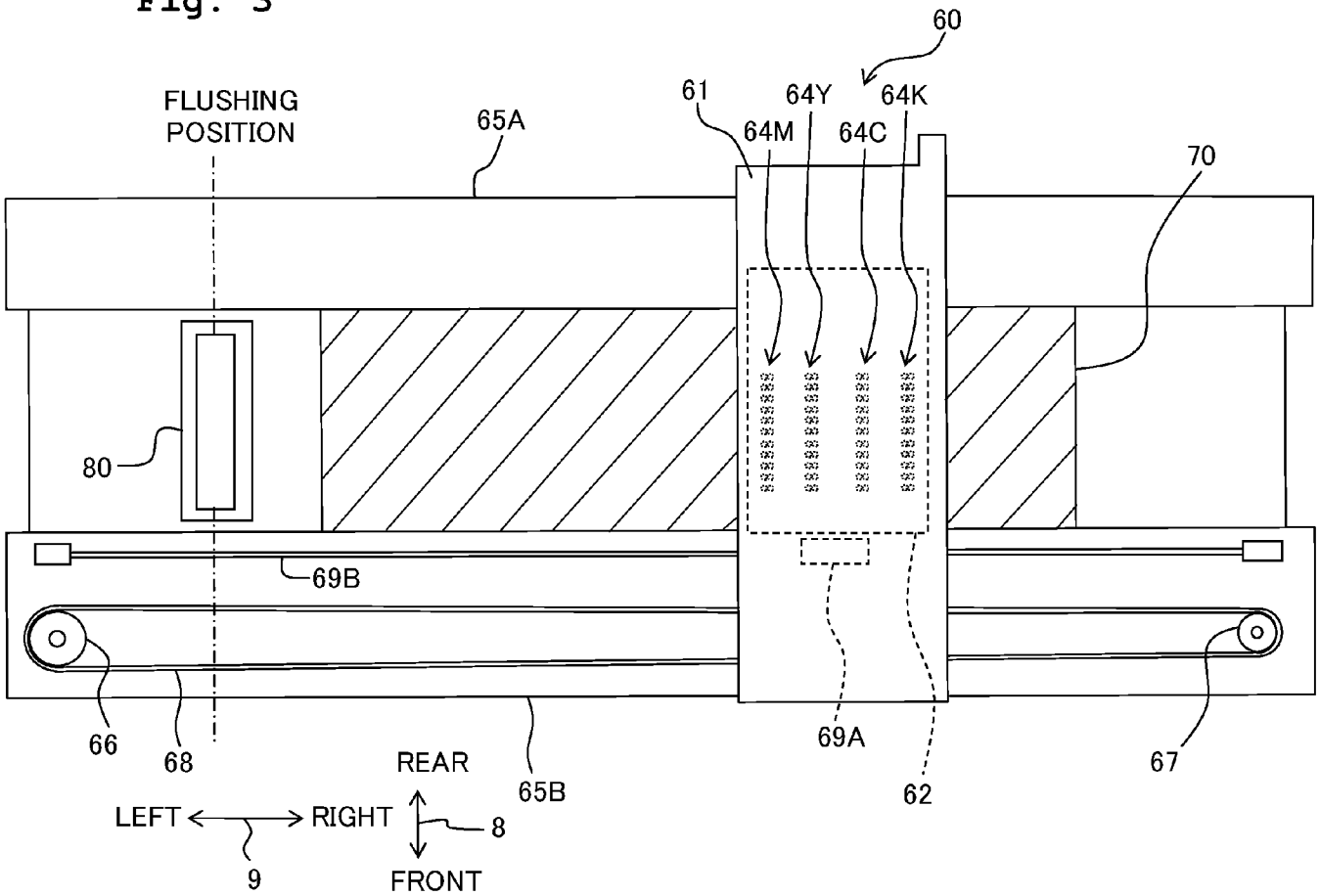
FIG. 3 is a plan view schematically illustrating peripheral mechanisms of a recording section.

The carriage 61 is provided above the transport path 23. As shown in FIG. 3, the carriage 61 is movably supported by two guide rails 65A and 65B extending in the left-right direction 9. In particular, the carriage 61 is reciprocatively movable in a direction perpendicular to the transport direction 15 and along the upper surface of the platen 70, that is, in the left-right direction 9 (an example of a main scanning direction of the present teaching). By moving the carriage 61 in the left-right direction 9, the recording head 62 carried on the carriage 61 also moves in the same direction.

A reciprocating mechanism is provided in the guide rail 65B. The reciprocating mechanism includes a driving pulley 66 which is provided in the guide rail 65B at one end in the left-right direction 9, a driven pulley 67 which is provided in the guide rail 65B at the other end in the left-right direction 9, and an endless annular belt 68 which is wound around the driving pulley 66 and the driven pulley 67. The driving pulley 66 is driven by a carriage motor 31 (see FIG. 4). The carriage 61 is coupled to the belt 68 on the bottom surface side. The driving pulley 66 is rotated by the carriage motor 31, the belt 68 performs a rounding motion in accordance with the rotation of the driving pulley 66, and the carriage 61 coupled to the belt 68 reciprocates in the left-right direction 9.

Further, an encoder strip 69B in the form of a band which extends in the left-right direction 9 is provided in the guide rail 65B. In the encoder strip 69B, transmitting sections and non-transmissive sections are formed alternately at a predetermined pitch in a longitudinal direction. In a process of moving the carriage 61, the encoder sensor 69A reads the transmitting sections and the non-transmissive sections of the encoder strip 69B to generate a pulse signal, and then outputs the generated pulse signal to the controller 130.

<Recording Head 62>

As shown in FIG. 2, the recording head 62 is provided on the lower surface of the carriage 61. A plurality of nozzle groups 64 are formed on a nozzle surface 63 (see FIG. 2), of the recording head 62, facing the platen 70. In the recording head 62, four nozzle groups 64K, 64C, 64Y, 64M which respectively discharge four colors of inks including black, cyan, yellow, and magenta are aligned in the left-right direction 9. More specifically, each of the nozzle groups 64 is aligned from right to left with respect to the nozzle surface 63 in the order of nozzle groups 64K, 64C, 64Y, 64M when the recording head 62 is seen in a plan view (seen from above). In the drawings, the nozzle groups 64K, 64C, 64Y, 64M are in some cases referred to as nozzle groups Bk (black), C (cyan), Y (yellow), M (magenta) respectively, or simply referred to as Bk, C, Y, M, respectively.

Here, each of the nozzle groups means a group of the plurality of nozzles. More specifically, each of the nozzle groups includes at least one nozzle array formed by the nozzles aligned in the front-rear direction 8. Each of the nozzle groups 64K, 64C, 64Y, 64M shown in FIG. 3 includes two nozzle arrays. In this embodiment, an explanation will be made on the assumption that the ink having the same color is discharged from the nozzles included in one nozzle group and the inks having mutually different colors are discharged from the nozzles included in the different nozzle groups, respectively. The present teaching, however, is not limited thereto. That is, the recording head 62 may be configured to discharge the ink having the same color from the nozzles included in the different nozzle groups, or the recording head 62 may be configured to discharge the inks having mutually different colors from the nozzles included in one nozzle group.

The recording section 60 discharges the inks of respective colors, which are supplied from the respective ink cartridges (not shown), from nozzle holes formed in the respective nozzle groups 64 during the reciprocating process in the left-right direction 9 by the control of the controller 130. By landing the jetted ink droplets on the recording paper sheet 19 transported on the platen 70, the image is recorded on the recording paper sheet 19.

<Waste Ink Tray 80>

As shown in FIG. 3, the waste ink tray 80 (an example of an ink receiver of the present teaching) is provided on one side of the platen 70 in the left-right direction 9 (left side in FIG. 3). The waste ink tray 80 is disposed outside a support area of the platen 70 in which the recording paper sheet 19 is supported (namely, outside of an image recording area) and within a moving range of the carriage 61. The upper surface of the waste ink tray 80 which faces the lower surface of the carriage 61 (namely, nozzle surface 63) is configured to be open, and it is possible to receive the ink droplets discharged from the nozzles of the recording head 62 by a flushing operation.

The flushing operation is an operation in which the ink is jetted from the nozzle holes of each of the nozzle groups 64 in the recording head 62 to the waste ink tray 80. The ink having a high viscosity due to the drying and the like is discharged from each of the nozzle holes by the flushing operation, and lands in the waste ink tray 80. In particular, in a case that the carriage 61 remains stationary or is in motion and that each of the nozzle groups 64 is positioned at a flushing position in accordance with the control of the controller 130, the ink is discharged from each of the nozzle groups 64 to the waste ink tray 80. The flushing position is a position at which each of the nozzle groups 64 faces the open upper surface of the waste ink tray 80, typically a central position of the waste ink tray 80 in the left-right direction 9.

<Controller 130>

The controller 130 shown in FIG. 4 controls the overall operation of the multifunction machine 10. As shown in FIG. 4, the controller 130 includes a CPU 131, a ROM 132, a RAM 133, an EERPOM 134, an ASIC 135, and an internal bus 137 connecting these components with one another. The ROM 132 stores, for example, the program for controlling various operations of the multifunction machine 10 by the CPU 131. The RAM 133 is used as a storage area for temporarily storing, for example, the data and the signal used when the CPU 131 executes the program. The EEPROM 134 stores, for example, the setting and the flag to be retained even after the power source is turned off.

The transport motor 30 and the carriage motor 31 are electrically connected to the ASIC 135. The ASIC 135 obtains a driving signal for rotating each motor from the CPU 131 and outputs a driving current depending on the driving signal to each motor. Each motor is driven and rotated forwardly or reversely by the driving current from the ASIC 135. For example, the controller 130 controls the driving of the transport motor 30 to rotate each of the rollers. Further, the controller 130 controls the driving of the carriage motor 31 to reciprocate the carriage 61. Furthermore, the controller 130 controls the recording head 62 to discharge the ink from the nozzle holes of each of the nozzle groups 64.

The optical sensor of the registration sensor 160, the optical sensor of the rotary encoder 165, and the encoder sensor 69A are electrically connected to the ASIC 135. The controller 130 detects a position of the recording paper sheet 19 based on the sensing signal outputted from the registration sensor 160 and the pulse signal outputted from the rotary encoder 165. Further, the controller 130 detects the position of the carriage 61 based on the pulse signal obtained from the encoder sensor 69A.

<Control by Controller 130>

An explanation will be made about an operation of the multifunction machine 10 with reference to FIGS. 5 to 10. The operation of the multifunction machine 10 (that is, the process shown in each of FIGS. 5 to 8) is executed by the CPU 131 of the controller 130. Each of the processes described below may be executed by reading the program stored in the ROM 132 by the CPU 131 or may be executed by a hardware circuit installed in the controller 130.

Figure 5:
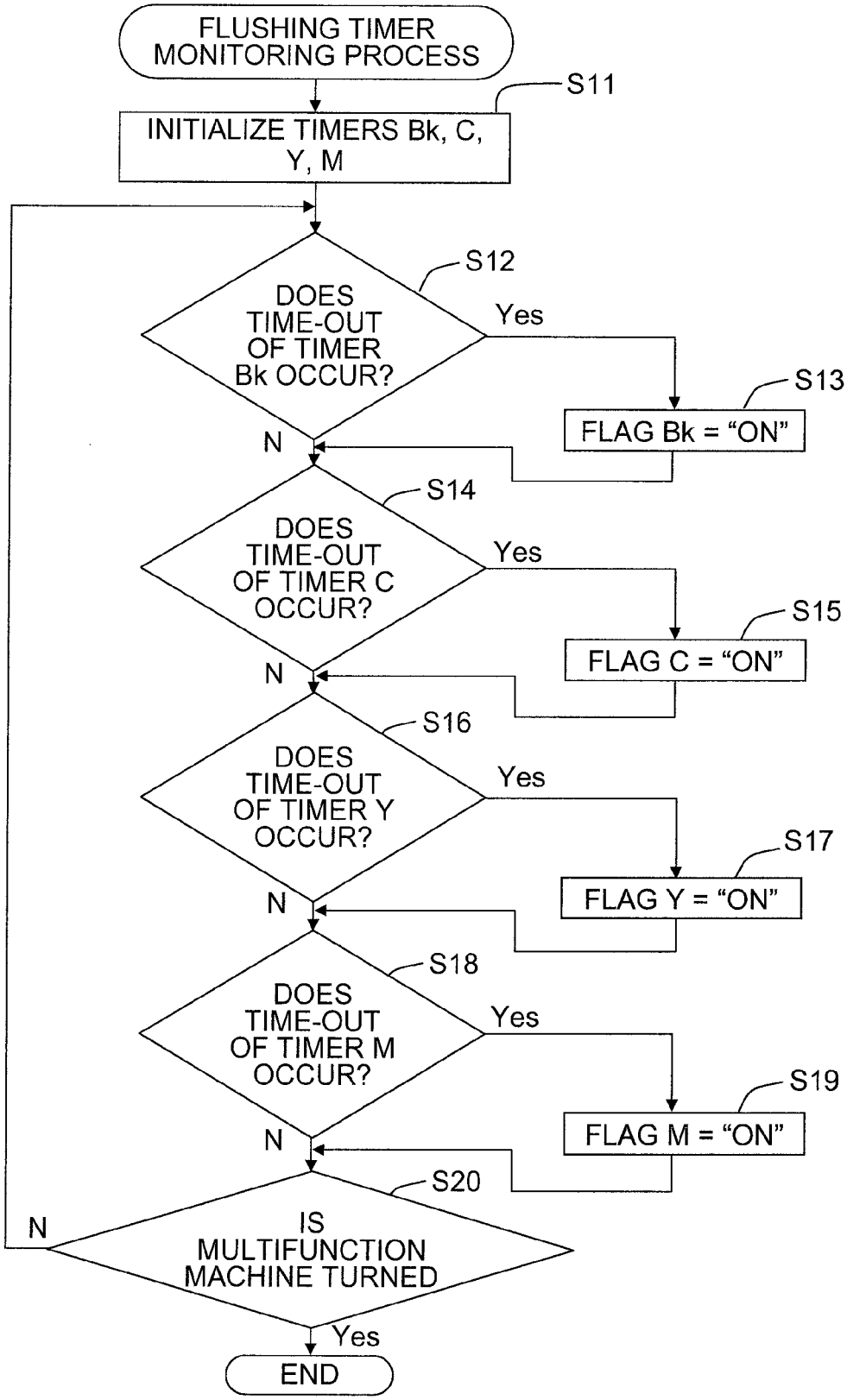
FIG. 5 is a flowchart of a flushing timer monitoring process.

At first, when the multifunction machine 10 is turned on, a flushing timer monitoring process shown in FIG. 5 is executed. The flushing timer monitoring process is a process for monitoring the arrivals of flushing timings, at which the flushing operations are performed for the nozzle groups 64K, 64C, 64Y, 64M, separately.

At first, the controller 130 initializes timers Bk, C, Y, M and "OFF" is set in flags Bk, C, Y, M (S11). Each of the timers Bk, C, Y, M is a timer for monitoring as to whether or not a predetermined time has elapsed after the flushing operation has been executed for each of the nozzle groups 64 most recently. Each of the flags Bk, C, Y, M is a flag indicating whether or not time-out of each of the timers Bk, C, Y, M occurs. In a case that the time-out of each of the timers Bk, C, Y, M does not occur, the "OFF" is set in each of the flags Bk, C, Y, M, and in a case that the time-out of each of the timers Bk, C, Y, M occurs, "ON" is set in each of the flags Bk, C, Y, M.

The controller 130 monitors the time-out of each of the timers Bk, C, Y, M until the multifunction machine 10 is turned off (S20: Yes) (S12, S14, S16, S18). In a case that the controller 130 detects the time-out of the timer Bk (S12: Yes), the "ON" is set in the flag Bk (S13). Similarly, in a case that the controller 130 detects the time-out of the timer C (S 14: Yes), the "ON" is set in the flag C (S 15); in a case that the controller 130 detects the time-out of the timer Y (S16: Yes), the "ON" is set in the flag Y (S17); and in a case that the controller 130 detects the time-out of the timer M (S18: Yes), the "ON" is set in the flag M (S 19).

Figure 6A:
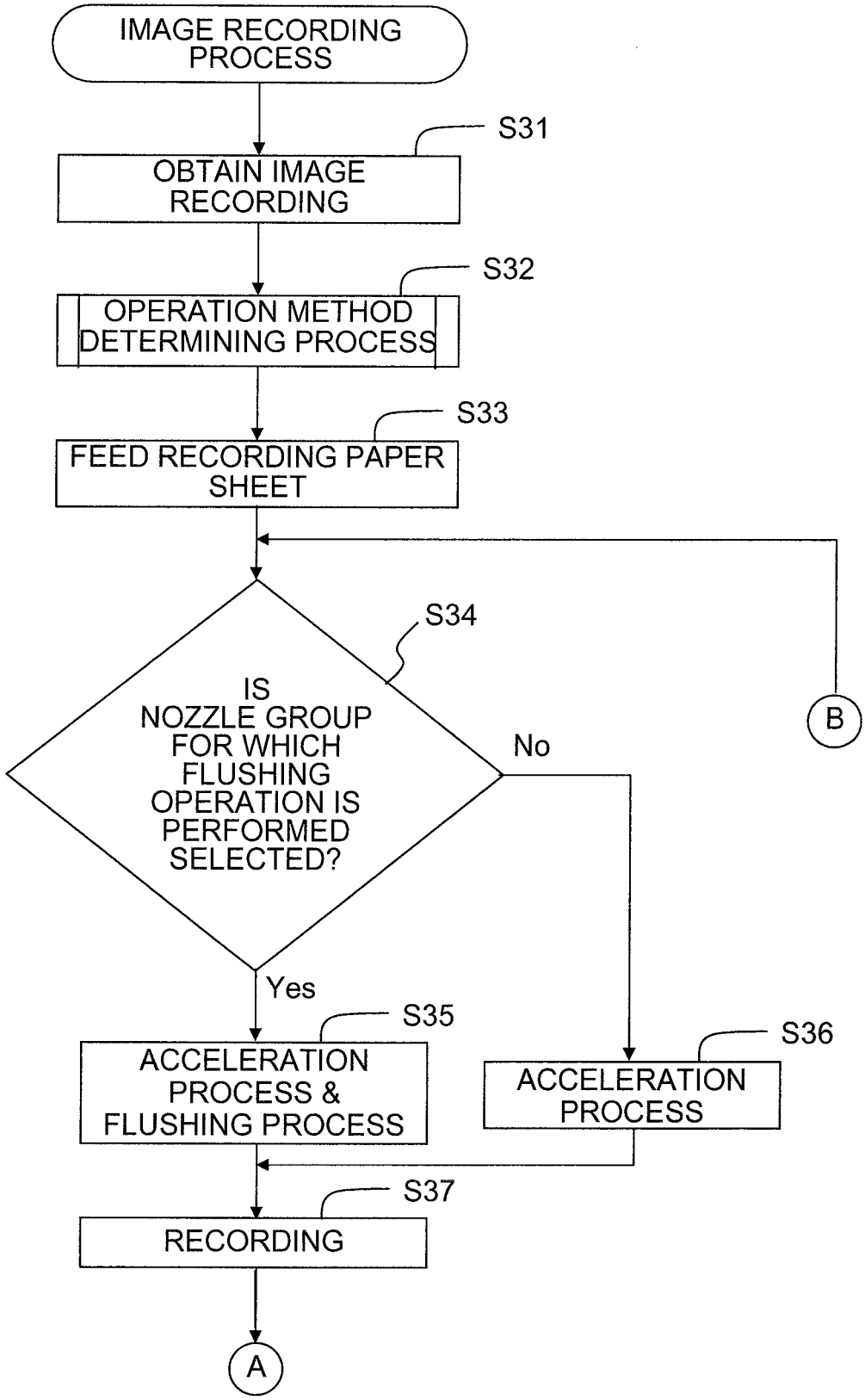
FIGS. 6A and 6B show a flowchart of an image recording process in the first embodiment.
Figure 6B:
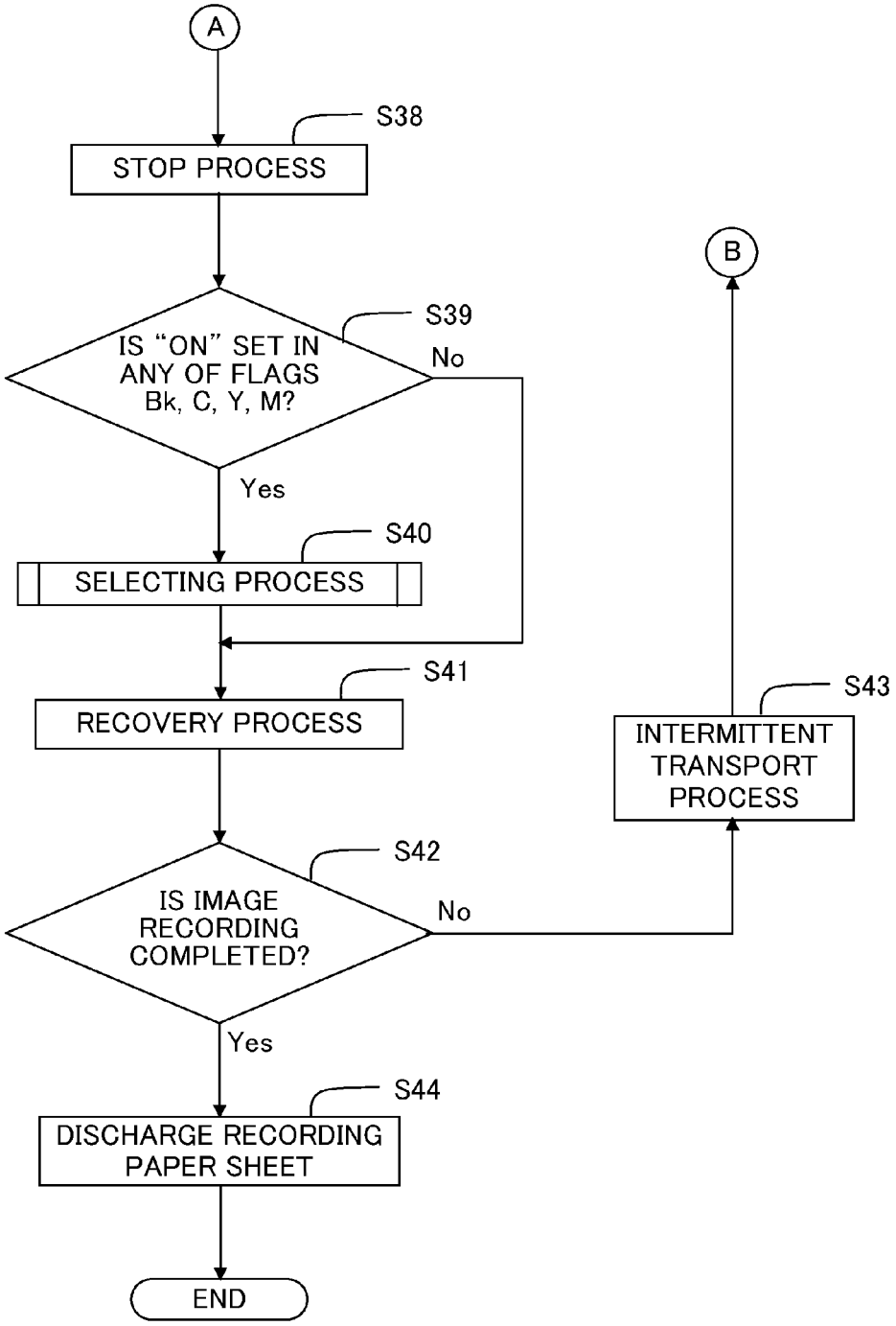

Further, the controller 130 allows the printer section 11 of the multifunction machine 10 to execute an image recording process shown in FIGS. 6A and 6B. The controller 130 executes the image recording process in parallel with the flushing timer monitoring process shown in FIG. 5.

Figure 9:
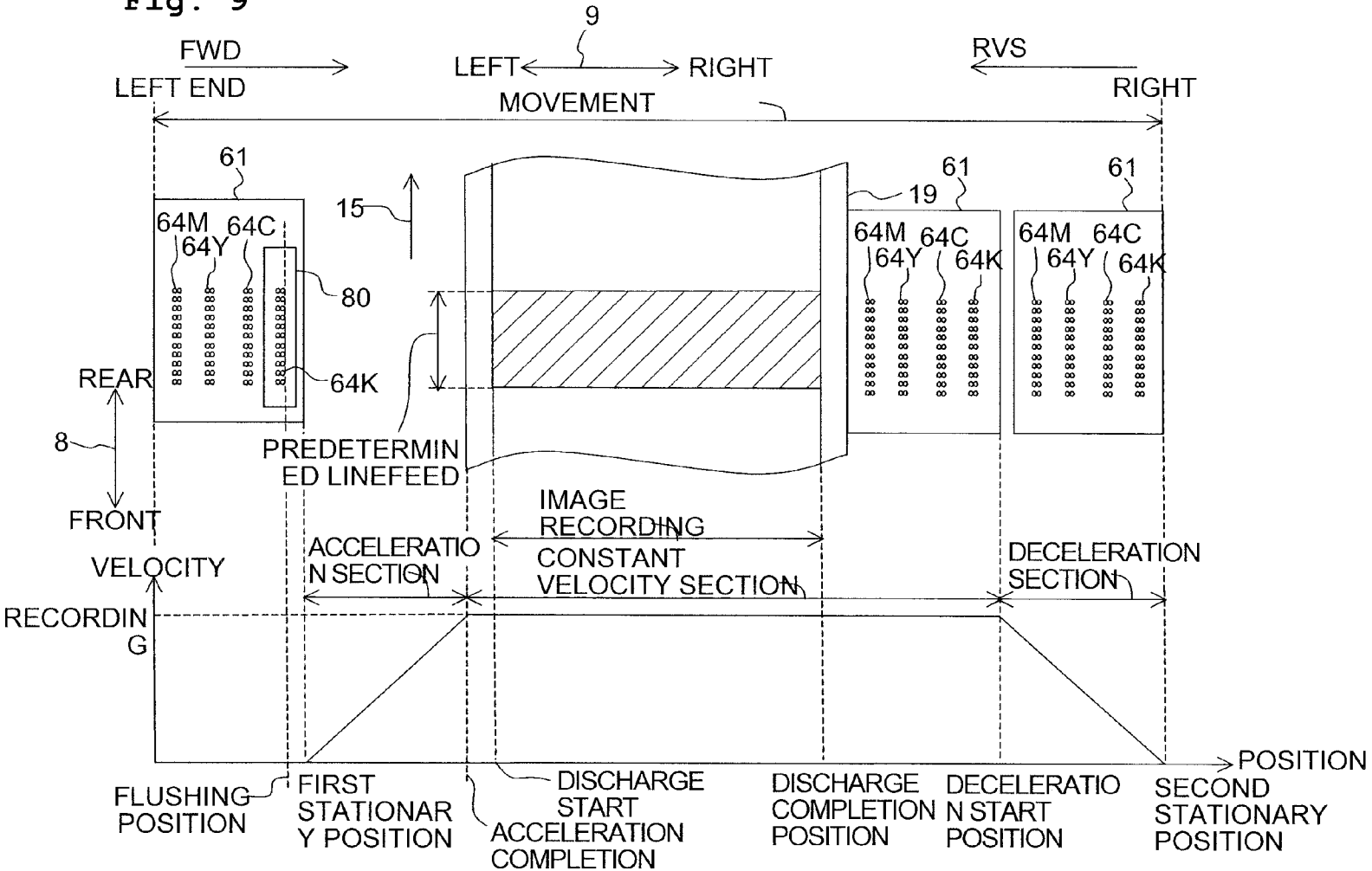
FIG. 9 schematically shows change or transition in a movement velocity of a carriage in the first embodiment.

At first, as shown in FIG. 9, it is assumed that the carriage 61 remains stationary on the left end side of a movement section of the carriage 61 at the time of starting the image recording process. Then, the controller 130 moves the carriage 61 in a FWD direction (an example of a first direction of the present teaching) in which the carriage 61 is moved from the left end (an example of one end of the present teaching) to the right end (an example of the other end of the present teaching) in the movement section and in an RVS direction (an example of a second direction of the present teaching) in which the carriage 61 is moved from the right end to the left end.

The controller 130 controls the recording head 62 to discharge the ink from the nozzle groups 64 during a process of moving the carriage 61 in the FWD direction, and thereby recording the image in an area having a predetermined line-feed width (a shaded area in FIG. 9) in the recording paper sheet 19. Further, the controller 130 executes the flushing operation for each of the nozzle groups 64 during the process of moving the carriage 61 in the FWD direction. Noted that, in the image recording process shown in FIGS. 6A and 6B, an explanation will be made about an example in which the image is not recorded on the recording paper sheet 19 during a process of moving the carriage 61 in the RVS direction. The present teaching, however, is not limited thereto.

At first, the controller 130 obtains an image recording instruction from a user (S31). A destination from which the image recording instruction is obtained is not especially limited, and the image recording instruction may be obtained, for example, through an operation panel (not shown) provided for the multifunction machine 10 or via a communication network from an external device. The image recording instruction is an instruction by which the controller 130 controls each of the rollers, the carriage 61, and the recording head 62 to record the image on the recording paper sheet 19. The image recording instruction includes image data of an image to be recorded on the recording paper sheet 19 and quality information indicating quality of the image to be recorded on the recording paper sheet 19. The quality information includes, for example, information indicating resolution of the image data or information indicating an amount of ink to be discharged on the recording paper sheet 19 per unit area. That is, the quality of the image is improved as the resolution of the image data is increased; and the quality of the image is improved as the amount of ink to be discharged per unit area is increased.

Figure 7:
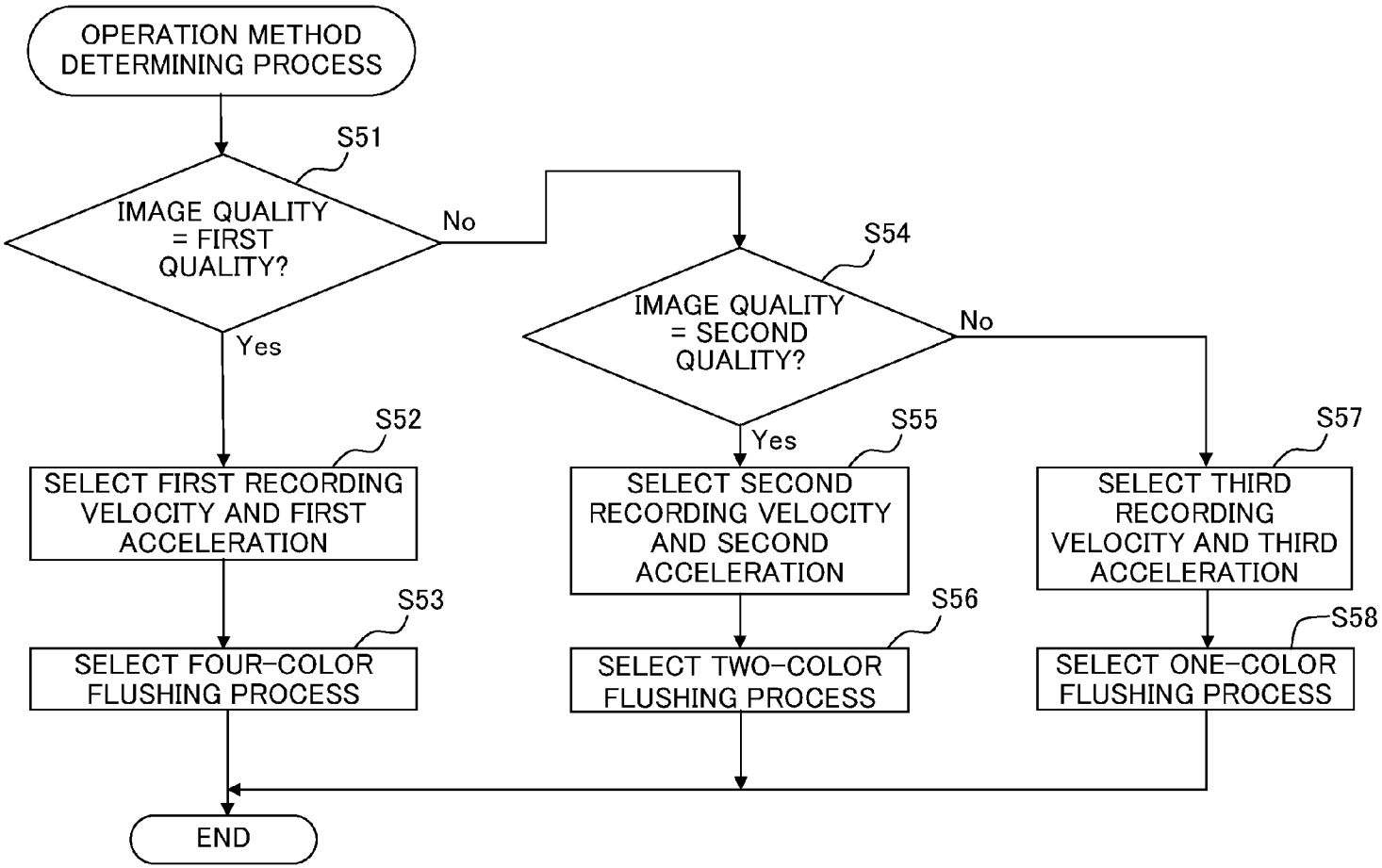
FIG. 7 is a flowchart of an operation method determining process in the first embodiment.

Next, the controller 130 executes an operation method determining process shown in FIG. 7 (S32). The operation method determining process is a process, in which a recording velocity which is a movement velocity of the carriage 61 during the image recording (that is, during a period in which the ink is discharged on the recording paper sheet 19 by the ink-jet head 62); acceleration for allowing the carriage 61 in the stationary state to reach the recording velocity; and the number of nozzle groups 64 for which the flushing operations are performed in one flushing process are determined, based on the quality information included in the image recording instruction. In each of the graphs shown in FIGS. 10A to 10C, the vertical axis indicates the recording velocity and the slope of the line indicates the acceleration. Further, in each of the graphs shown in FIGS. 10A to 10C, change or transition in the velocity after the movement velocity of the carriage 61 has arrived at the recording velocity (more specifically, change or transition in the velocity in a deceleration section) is omitted.

At first, the controller 130 compares image quality indicated by the obtained quality information with a predetermined first quality (S51). In a case that the image quality is the first quality (S51: Yes), the controller 130 selects a first recording velocity and a first acceleration shown in FIG. 10A (S52) and selects a four-color flushing process (S53). The first recording velocity is the movement velocity of the carriage 61 for recording an image having the first quality by the recording head 62 in a recording process as will be described later. The first acceleration is acceleration for allowing the movement velocity of the carriage 61 to reach the first recording velocity in an acceleration process as will be described later.

The four-color flushing process is a process in which the flushing operation is performed for each of the four nozzle groups 64K, 64C, 64Y, 64M in the flushing process as will be described later. The one flushing process means the flushing operation(s) executed by the controller 130 during a time from the carriage 61, which remains stationary at the left end side of the movement section, moves in the FWD direction and until the carriage 61 reaches the platen 70 (namely, the image recording area).

In a case that the image quality is different from the first quality (S51: No), the controller 130 compares the image quality indicated by the obtained quality information with a predetermined second quality (S54). In a case that the image quality is the second quality (S54: Yes), the controller 130 selects a second recording velocity and a second acceleration shown in FIG. 10B (S55) and selects a two-color flushing process (S56). The relation between the second recording velocity and the second acceleration is the same as the relation between the first recording velocity and the first acceleration. The second quality is lower than the first quality; the second recording velocity is faster than the first recording velocity; and the second acceleration is greater than the first acceleration. The two-color flushing process is a process in which the flushing operation is performed for each of the two nozzle groups 64 selected from the four nozzle groups 64K, 64C, 64Y, 64M in the flushing process as will be described later.

In a case that the image quality is different from the second quality (S54: No), the controller 130 judges that the image quality is a third quality. Then, the controller 130 selects a third recording velocity and a third acceleration shown in FIG. 10C (S57) and selects a one-color flushing process (S58). The relation between the third recording velocity and the third acceleration is the same as the relation between the first recording velocity and the first acceleration. The third quality is lower than the second quality; the third recording velocity is faster than the second recording velocity; and the third acceleration is greater than the second acceleration. The one-color flushing process is a process in which the flushing operation is performed for one nozzle group 64 selected from the four nozzle groups 64K, 64C, 64Y, 64M in the flushing process as will be described later.

The first recording velocity and the first acceleration are correlated with the first quality; the second recording velocity and the second acceleration are correlated with the second quality; and the third recording velocity and the third acceleration are correlated with the third quality, and then they are stored in the EEPROM 134 (an example of a storage of the present teaching), respectively. That is, combinations of the respective recording velocities and the respective accelerations are stored in the EEPROM 134 while being correlated with a plurality pieces of quality information each indicating the image quality to be recorded on the recording paper sheet 19. Then, the controller 130 reads the recording velocity and the acceleration correlated with the image quality to be recorded from the EEPROM 134 in the operation method determining process. It is noted that, the recording velocity stored in the EEPROM 134 is increased as the quality indicated by the corresponding quality information is lowered. Further, the acceleration stored in the EEPROM 134 is increased as the corresponding recording velocity is increased.

The operation method determining process shown in FIG. 7 is a process as follows. That is, as the image quality indicated by the obtained quality information is improved, the recording velocity is decreased, the acceleration is decreased, and the number of nozzle groups for which the flushing operations are performed in one flushing process is increased. In other words, the operation method determining process shown in FIG. 7 is a process as follows. That is, as the image quality indicated by the obtained quality information is lowered, the recording velocity is increased, the acceleration is increased, and the number of nozzle groups for which the flushing operations are performed in one flushing process is decreased.

Returning again to the process in FIGS. 6A and 6B, the controller 130 feeds the recording paper sheet 19 placed on the paper feed tray 20 to a recording start position (S33). In particular, the controller 130 rotates the paper feed roller 25 by the driving force of the transport motor 30 to feed the recording paper sheet 19 on the paper feed tray 20 to the transport path 23. Subsequently, when the front end of the recording paper sheet 19 arrives at the transport roller section 50, the controller 130 rotates the transport roller 151 by the driving force of the transport motor 30 to transport the recording paper sheet 19 to the recording start position. The recording start position is a position at which an area of the recording paper sheet 19 to which the image is recorded first faces the nozzle surface 63 of the recording head 62. Further, the controller 130 performs judgments of the arrivals of the recording paper sheet 19 at the transport roller section 50 and the recording start position based on a combination of the sensing signal of the registration sensor 160 and the pulse signal of the rotary encoder 165, those of which are outputted to the controller 130.

Next, the controller 130 judges as to whether or not each of the nozzle groups 64 for which the flushing operation is performed is selected in a selecting process (S40) as will be described later on (S34). At a stage of step S34 immediately after the image recording instruction has been obtained, the selecting process has not yet been executed by the controller 130. Thus, the controller 130 judges that each of the nozzle groups 64 for which the flushing operation is performed is not yet selected (S34: No), and executes an acceleration process in which the carriage 61 is accelerated in an acceleration section ranging from a first stationary position to an acceleration completion position (S36).

As shown in FIG. 9, a position corresponding to the right end of the carriage 61 which remains stationary on the left end side in the movement section (that is, the end portion of the carriage 61 on the downstream side in the FWD direction) is defined as the first stationary position. Further, in this embodiment, a position corresponding to the left end of the recording paper sheet 19 is defined as the acceleration completion position. Then, in the acceleration process (S36), the controller 130 moves the carriage 61, which remains stationary at the first stationary position, in the FWD direction at the acceleration selected in the operation method determining process (S32). As a result, the movement velocity at a time when the right end of the carriage 61 has arrived at the acceleration completion position reaches the recording velocity selected in the operation method determining process (S32).

The reference for defining the first stationary position is not limited to the right end of the carriage 61. The same is true on references for defining other positions. As an example, the reference for defining the first stationary position may be a position of the encoder sensor 69A carried on the carriage 61. Further, the acceleration completion position may be any position provided that the position is positioned on the downstream of the first stationary position in the FWD direction and on the upstream of a discharge start position in the FWD direction or the position is consistent with the discharge start position. The acceleration completion position is not limited to the left end of the recording paper sheet 19 as described above.

Subsequently, the controller 130 executes the recording process (S37) in which the carriage 61 is moved at the recording velocity to maintain a constant velocity and the ink is discharged from each of the nozzle groups 64 of the recording head 62 in an image recording section ranging from the discharge start position to a discharge completion position shown in FIG. 9. The image recording section of this embodiment is a section which is positioned on the downstream side of the acceleration completion position in the FWD direction and in which the carriage 61 faces the recording paper sheet 19. However, the discharge start position may be coincident with the acceleration completion position.

In other words, for example, in a case that the carriage 61 is moved in the FWD direction, the discharge start position means the most upstream position in the FWD direction (namely, the leftmost side) at which the ink is discharged from each of the nozzle groups 64 and the discharge completion position means the most downstream position in the FWD direction (namely, the rightmost side) at which the ink is discharged from each of the nozzle groups 64. In marginless printing, the image recording section is set as a range which is larger than a width of the recording paper sheet 19 in the left-right direction 9 by about 5 mm in order to allow the ink to also land on both margins of the recording paper sheet 19 in the left-right direction 9. More specifically, the discharge start position may be a position on the left side of the left margin of the recording paper sheet 19 by about 5 mm and the discharge completion position may be a position on the right side of the right margin of the recording paper sheet 19 by about 5 mm. That is, the image recording section may be a section included in a range between the acceleration completion position and the other end.

Subsequently, the controller 130 executes a stop process (S38) in which the carriage 61 is gradually decelerated from the point in time at which the right end of the carriage 61 reaches a deceleration start position shown in FIG. 9 and the carriage 61 is stopped at the point in time at which the right end of the carriage 61 reaches a second stationary position shown in FIG. 9. The deceleration start position is defined as a position at which at least the left end of the carriage 61 (namely, the end portion of the carriage 61 on the upstream side in the FWD direction) has passed through the image recording section (in the example of FIG. 9, a position corresponding to the right end of the carriage 61 at a point of time at which the left end of the carriage 61 has passed through the image recording section). The deceleration start position in this embodiment is a position corresponding to the right end of the carriage 61 at a point of time at which the left end of the carriage 61 has passed through the recording paper sheet 19 in the FWD direction.

Next, the controller 130 judges as to whether or not the "ON" is set in any of the flags Bk, C, Y, M while the carriage 61 remains stationary at the second stationary position (S39). That is, the controller 130 judges as to whether or not the time-out occurs in any of the timers Bk, C, Y, M in the flushing timer monitoring process performed concurrently with the image recording process. In a case that the "ON" is set in any of the flags Bk, C, Y, M (S39: Yes), the controller 130 executes the selecting process (S40). In a case that the "OFF" is set in all of the flags Bk, C, Y, M (S39: No), the controller 130 skips over the selecting process (S40).

Figure 8A:
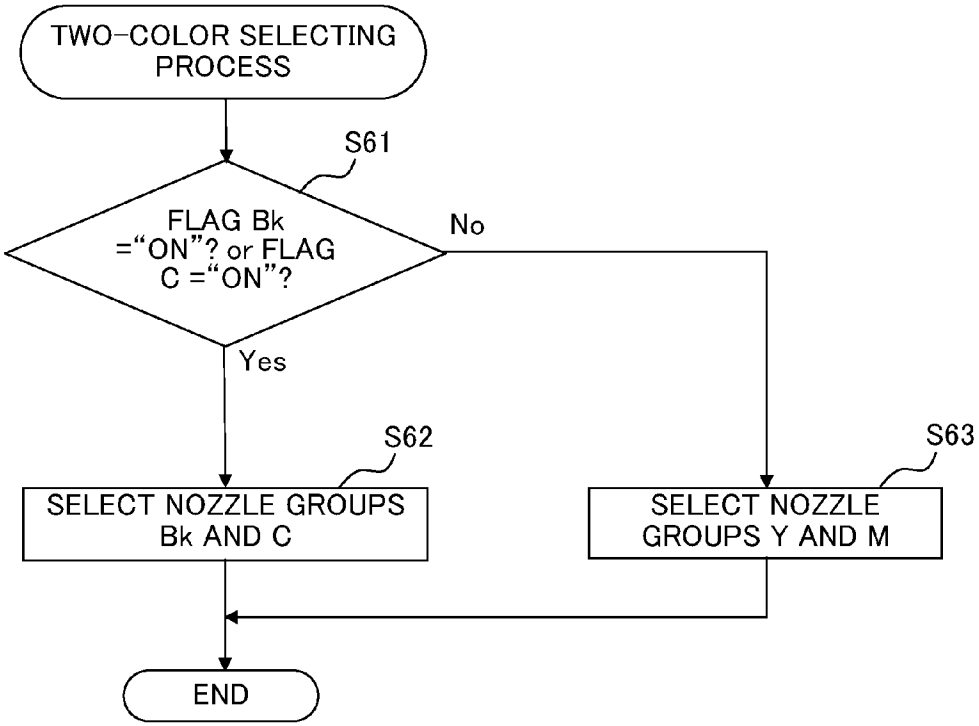

In a case that the four-color flushing process is selected in the operation method determining process (S32), all of the nozzle groups 64K, 64C, 64Y, 64M are selected in step S40. In a case that the controller 130 selects the two-color flushing process in the operation method determining process (S32), a two-color selecting process shown in FIG. 8A is carried out in step S40. In a case that the controller 130 selects the one-color flushing process in the operation method determining process (S32), a one-color selecting process shown in FIG. 8B is carried out in step S40.

The two-color selecting process shown in FIG. 8A is a process in which two nozzle groups for which the flushing operations are performed in the subsequent flushing process are selected from the four nozzle groups 64K, 64C, 64Y, 64M.

At first, the controller 130 judges as to whether or not the "ON" is set in the flag Bk or the flag C (S61). In a case that the "ON" is set in the flag Bk or the flag C (S61: Yes), the controller 130 selects the nozzle groups 64K and 64C as the nozzle groups for which the flushing operations are performed in the subsequent flushing process (S62). On the other hand, in a case that the "OFF" is set in both the flag Bk and the flag C (S61: No), the "ON" should be set in the flag Y or the flag M. Thus, the controller 130 selects the nozzle groups 64Y and 64M as the nozzle groups for which the flushing operations are performed in the subsequent flushing process (S63). In the example of FIG. 8A, the explanation has been made with respect to the example in which setting values of the flag Bk and the flag C are confirmed first. The present teaching, however, is not limited thereto, and it is needless to mention that setting values of the flag Y and the flag M may be confirmed first.

Figure 8B:
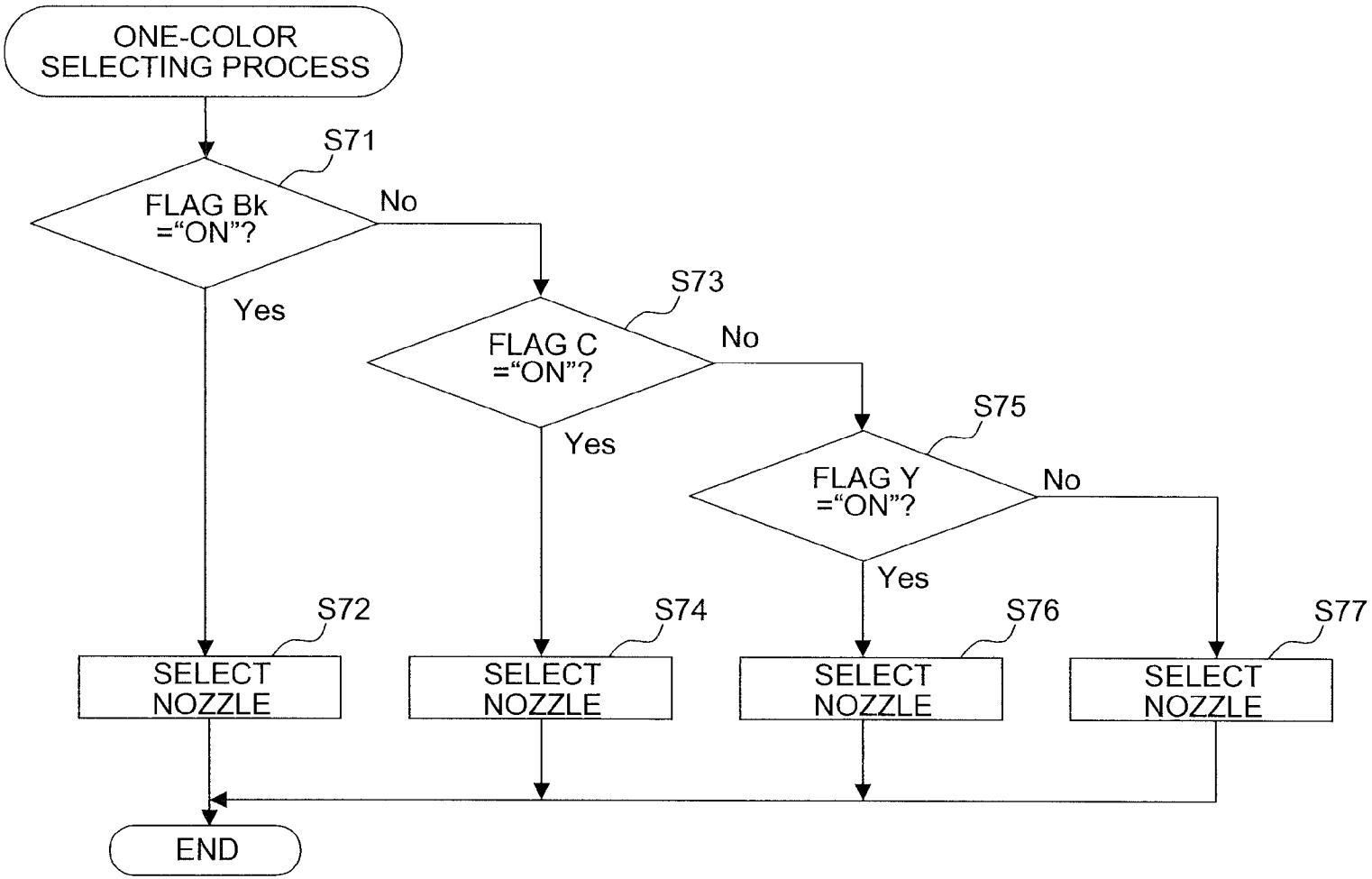

The one-color selecting process shown in FIG. 8B is a process in which one nozzle group for which the flushing operation is performed in the subsequent flushing process is selected from the four nozzle groups 64K, 64C, 64Y, 64M.

At first, the controller 130 judges as to whether or not the "ON" is set in the flag Bk (S71). In a case that the "ON" is set in the flag Bk (S71: Yes), the controller 130 selects the nozzle group 64K as the nozzle group for which the flushing operation is performed in the subsequent flushing process (S72). On the other hand, in a case that the "OFF" is set in the flag Bk (S71: No), the controller 130 judges as to whether or not the "ON" is set in the flag C (S73). In a case that the "ON" is set in the flag C (S73: Yes), the controller 130 selects the nozzle group 64*c* as the nozzle group for which the flushing operation is performed in the subsequent flushing process (S74). On the other hand, in a case that the "OFF" is set in the flag C (S73: No), the controller 130 judges as to whether or not the "ON" is set in the flag Y (S75). In a case that the "ON" is set in the flag Y (S75: Yes), the controller 130 selects the nozzle group 64Y as the nozzle group for which the flushing operation is performed in the subsequent flushing process (S76). On the other hand, in a case that the "OFF" is set in the flag Y (S75: No), the "ON" should be set in the flag M. Thus, the controller 130 selects the nozzle group 64M as the nozzle group for which the flushing operation is performed in the subsequent flushing process (S77).

That is, the controller 130 confirms the setting values of the flags Bk, C, Y, M in order and selects the nozzle group corresponding to the flag in which the "ON" is set. Noted that, the order in which the setting values of the flags Bk, C, Y, M are confirmed is not limited to the example of FIG. 8B.

Returning again to FIGS. 6A and 6B, the controller 130 executes a recovery process in which the carriage 61 which remains stationary at the second stationary position is moved in the RVS direction and then is stopped at the first stationary position (S41). Here, the controller 130 stops the nozzle group positioned on the most upstream side in the RVS direction (the most downstream side in the FWD direction), of the nozzle groups selected in the selecting process, at the flushing position. More specifically, the controller 130 stops the nozzle array, of said nozzle group, positioned on the most upstream side in the RVS direction (the most downstream side in the FWD direction) at the flushing position. That is, the first stationary position is not fixed to the position shown in FIG. 9, and is moved or deviated in the left-right direction 9 depending on the content of the flashing process to be performed next. More specifically, the first stationary position is defined as a position corresponding to the right end of the carriage 61 at a time when the nozzle group positioned on the most upstream side in the RVS direction (the most downstream side in the FWD direction), of the nozzle groups selected in the selecting process, is positioned at the flushing position.

Figure 10A:
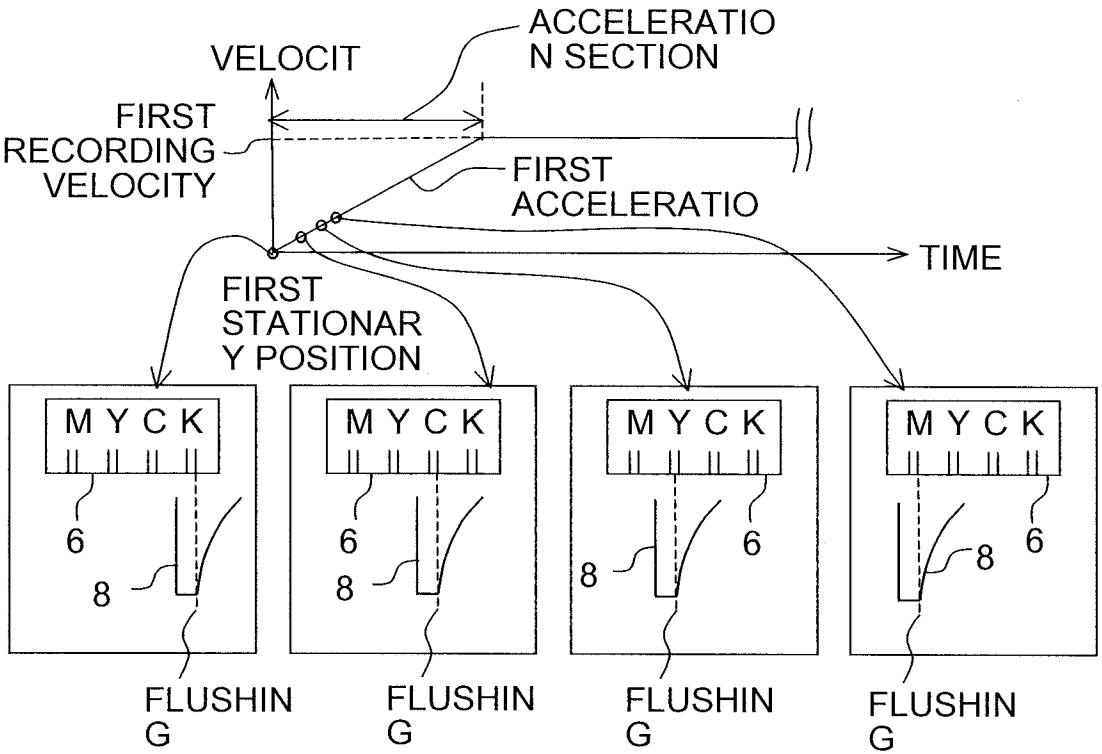
Figure 10B:
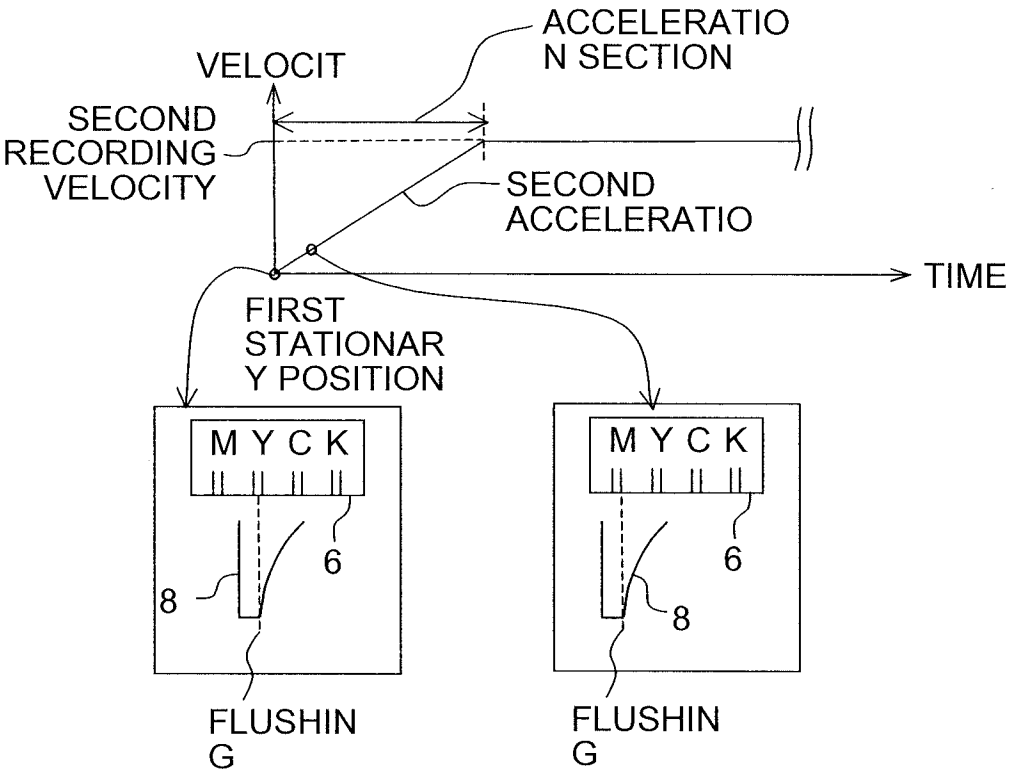
Figure 10C:
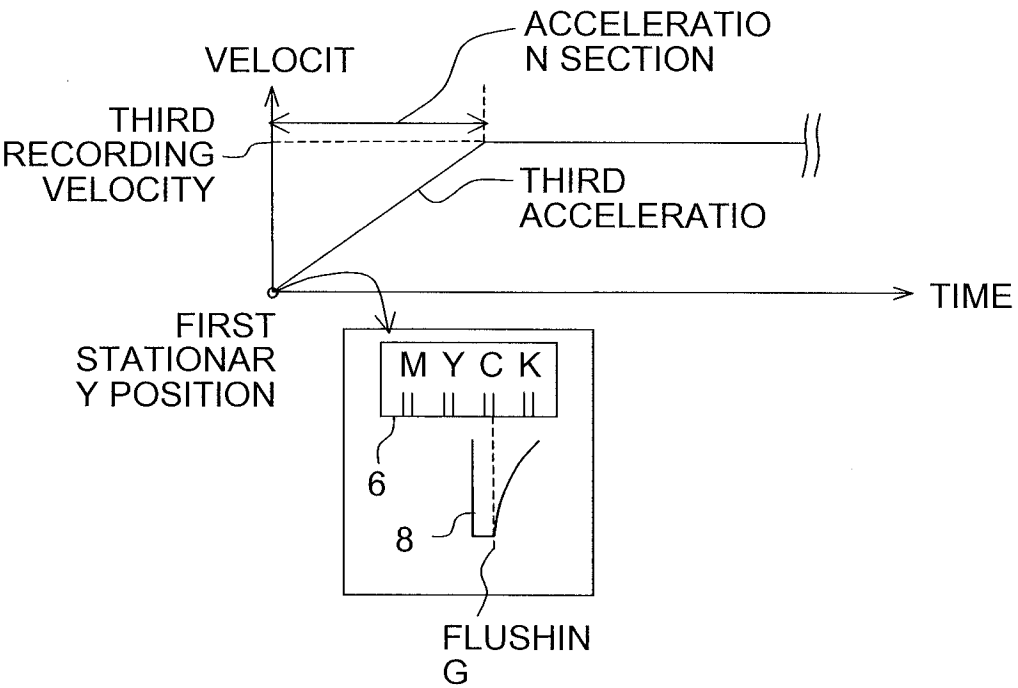

In particular, in a case that the four nozzle groups 64K, 64C, 64Y, 64M are selected in the selecting process (S40), the controller 130 stops the carriage 61 so that the position of the nozzle group 64K is coincident with the flushing position as shown in FIG. 10A. In a case that the two nozzle groups 64Y, 64M are selected in the selecting process (S40), the controller 130 stops the carriage 61 so that the position of the nozzle group 64Y is coincident with the flushing position as shown in FIG. 10B. In a case that one nozzle group 64C is selected in the selecting process (S40), the controller 130 stops the carriage 61 so that the position of the nozzle group 64C is coincident with the flushing position as shown in FIG. 10C.

Subsequently, the controller 130 judges as to whether or not the image recording on the recording paper sheet 19 is completed (S42). In a case that the image recording is not completed, the controller 130 executes an intermittent transport process in which the recording paper sheet 19 is transported in the transport direction 15 by a predetermined linefeed width (S43). In particular, the controller 130 rotates the transport motor 30 by a predetermined number of revolutions to allow the transport roller section 50 and/or the discharge roller section 55 to transport the recording paper sheet 19 by the predetermined linefeed width. As a result, an area of the recording paper sheet 19 to which the image recording is performed next faces the recording head 62.

Next, the controller 130 judges (S34) as to whether or not at least one nozzle group for which the flushing operation is performed is selected in the selecting process (S40). In a case that at least one nozzle group for which the flushing operation is performed is selected (S34: Yes), the controller 130 executes the flushing process during the acceleration process (S35). It is noted that, since the acceleration process is the same as step S36, the explanation thereof will be omitted.

As an example, as shown in FIG. 10A, in a case that the four nozzle groups 64K, 64C, 64Y, 64M are selected, the controller 130 starts the acceleration process simultaneously with the flushing operation for the nozzle group 64K. Subsequently, the flushing operation is executed for each of the nozzle groups 64C, 64Y, 64M by the controller 130 when each of the nozzle groups 64C, 64Y, 64M arrives at the flushing position during a process of moving the carriage 61 in the FWD direction. Then, the controller 130 initializes the timers Bk, C, Y, M of the nozzle groups 64K, 64C, 64Y, 64M for which the flushing operations have been performed respectively.

As another example, as shown in FIG. 10B, in a case that two nozzle groups 64Y and 64Y are selected, the controller 130 starts the acceleration process simultaneously with the flushing operation for the nozzle group 64Y. Subsequently, the flushing operation is executed for the nozzle group 64M by the controller 130 when the nozzle group 64M arrives at the flushing position during the process of moving the carriage 61 in the FWD direction. Then, the controller 130 initializes the timers Y and M of the nozzle groups 64Y and 64M for which the flushing operations have been performed respectively.

As still another example, as shown in FIG. 10C, in a case that one nozzle group 64C is selected, the controller 130 starts the acceleration process simultaneously with the flushing operation for the nozzle group 64C. Then, the controller 130 initializes the timer C of the nozzle group 64C for which the flushing operation has been performed.

After that, the controller 130 repeatedly executes the process of steps S34 to S43 until the image recording on the recording paper sheet 19 is completed (S42: Yes). In a case that it is judged that the image recording on the recording paper sheet 19 is completed (S42: Yes), the controller 130 discharges the recording paper sheet 19 on the paper discharge tray 21 (S44). In particular, the controller 130 rotates the transport motor 30 by a predetermined number of revolutions to allow the discharge roller section 55 to discharge the recording paper sheet 19.

[Operation and Effect of First Embodiment]

According to the first embodiment, in a case that the acceleration of the carriage 61 in the acceleration section is great (that is, the quality is low), the number of nozzle groups 64 for which the flushing operations are performed in one flushing process is decreased. Accordingly, the ink discharged from each of the nozzle groups 64 can be landed in the waste ink tray 80 reliably. On the other hand, in a case that the acceleration of the carriage 61 in the acceleration section is small (that is, the quality is high), the number of nozzle groups 64 for which the flushing operations are performed in one flushing process is increased. Accordingly, the number of flushing processes can be decreased. That is, the throughput of the recording process can be maintained and further the discharged ink can be landed in the waste ink tray 80 reliably.

In the first embodiment, since the nozzle group for which the flushing operation is performed first is stopped at the flushing position, the flushing operation for said nozzle group can be performed concurrently with the start of the acceleration process. Accordingly, it is possible to execute the flushing process by using a period of the acceleration process effectively.

In the operation method determining process (S32) of the first embodiment, the image quality is defined to have three stages (first quality, second quality, and third quality). The present teaching, however, is not limited thereto. For example, a plurality of qualities may be defined between the first quality and the second quality, and between the second quality and the third quality. In a case that the image quality is not less than the first quality, it may be judged as "Yes" in step S51; in a case that the image quality is less than the first quality and not less than the second quality, it may be judged as "Yes" in step S54; and in a case that the image quality is less than the second quality, it may be judged as "No" in step S54. Further, since the quality is correlated one-to-one with the acceleration, the number of nozzle groups for which the flushing operations are performed in one flushing process may be changed depending on the acceleration instead of the image quality. That is, the number of nozzle groups may be increased as the acceleration is decreased; and the number of nozzle groups may be decreased as the acceleration is increased.

In the operation method determining process (S32) of the first embodiment, the velocity and the acceleration are stored in the EEPROM 134 while being correlated with the quality information. The present teaching, however, is not limited thereto. For example, velocity profile, of which velocity changes over time, may be stored in the EEPROM 134 while being correlated with the image quality. As an example, a first velocity profile of the first quality may have a velocity (that is, recording velocity) in a constant velocity section lower than that of a second velocity profile of the second quality; and the first velocity profile of the first quality may have a rate of change of velocity (that is, acceleration) starting from the stationary state and arriving at the constant velocity which is lower than that of the second velocity profile of the second quality.

[Second Embodiment]

Subsequently, an explanation will be made about an image recording process according to the second embodiment with reference to FIGS. 11 to 14. The explanation of common parts between the first and second embodiments is omitted, and differences between the first and second embodiments will be explained in detail. The image recording process of the second embodiment is different from that of the first embodiment in that the number of nozzle groups 64 for which the flushing operations are performed in one flushing process can be changed during the image recording on one recording paper sheet 19.

Figure 11A:
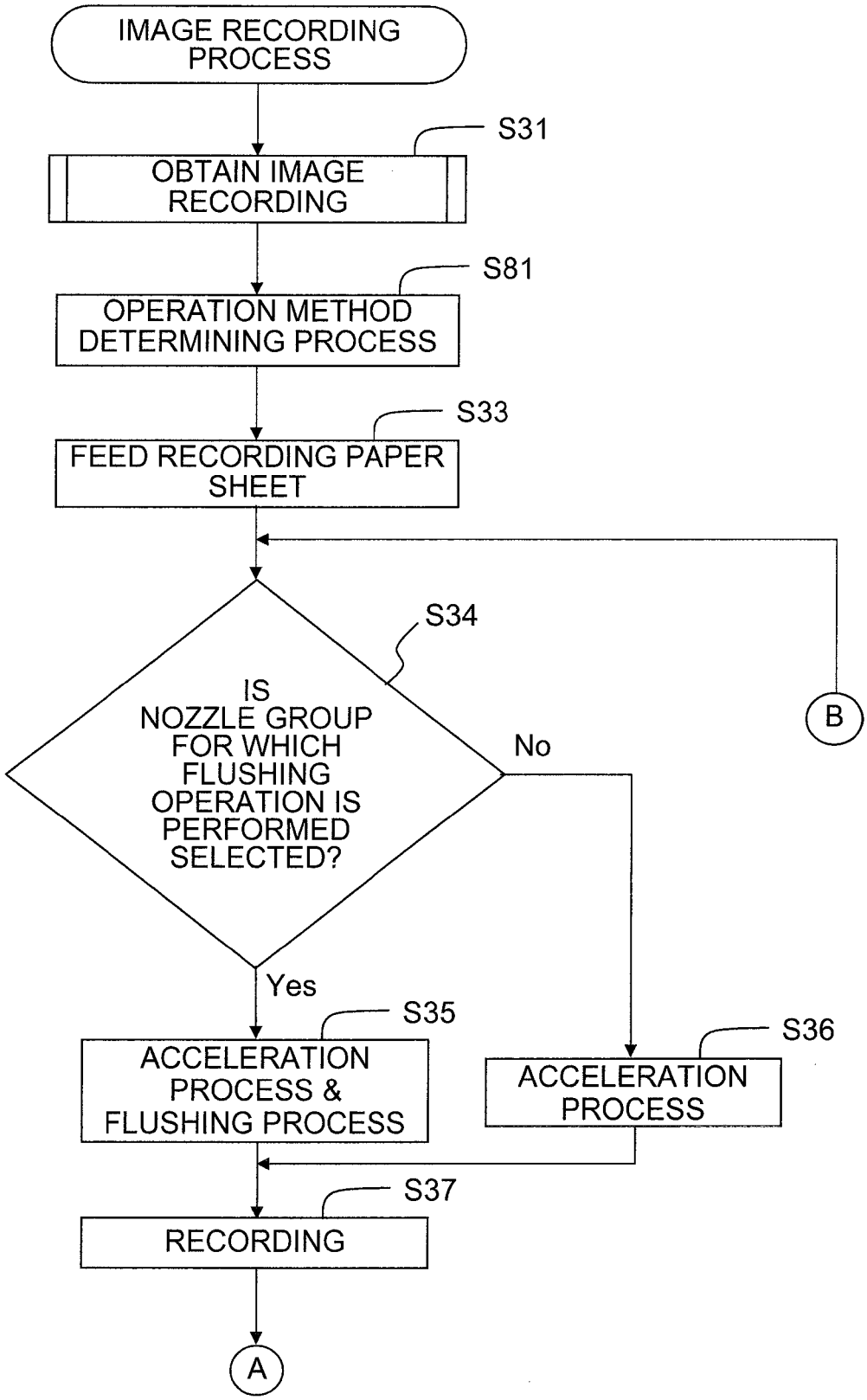
FIGS. 11A and 11B show a flowchart of an image recording process in the second embodiment.
Figure 11B:
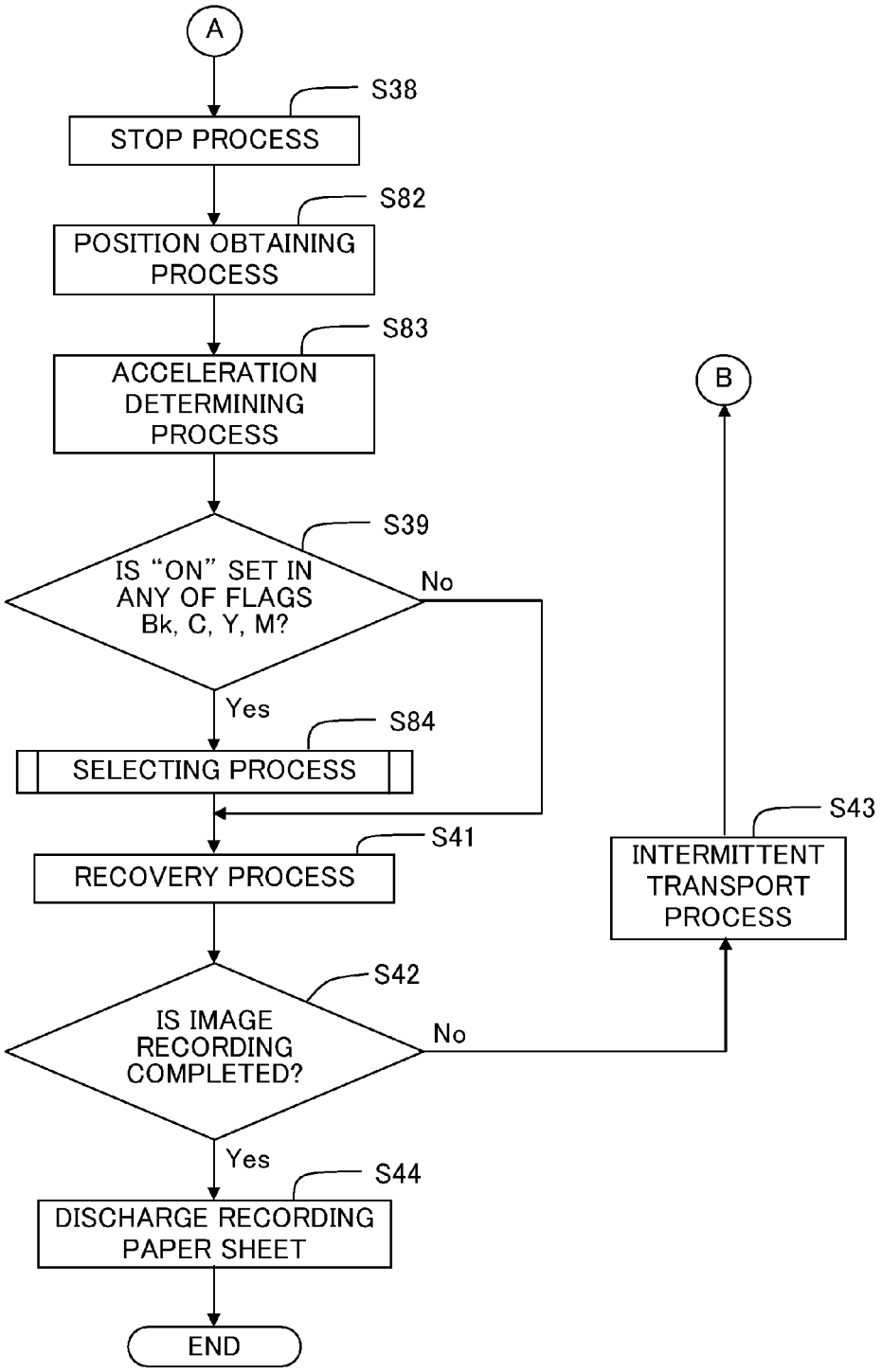
Figure 12:
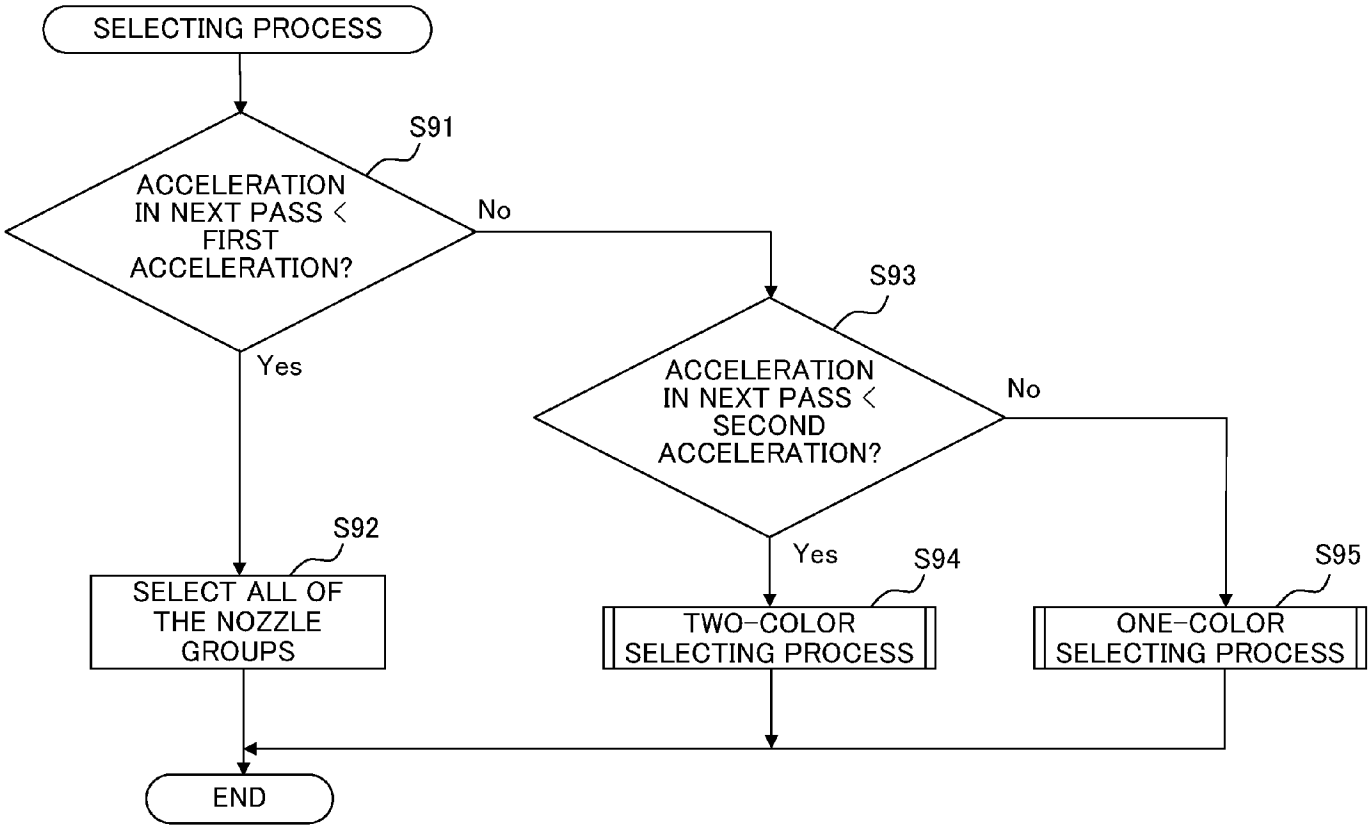
FIG. 12 is a flowchart of a selecting process in the second embodiment.

At first, the controller 130 determines only the recording velocity depending on the image quality in an operation method determining process shown in FIGS. 11A and 11B (S81). That is, in the operation method determining process shown in FIG. 7, in a case that the image quality is the first quality (S51: Yes), the controller 130 selects the first recording velocity; in a case that the image quality is the second quality (S54: Yes), the controller 130 selects the second recording velocity; and in a case that the image quality is the third quality (S54: No), the controller 130 selects the third recording velocity. Meanwhile, the acceleration is determined in an acceleration determining process (S83) which will be described later; and the number of nozzle groups for which the flushing operations are performed in one flushing process is determined in a selecting process (S84) as will be described later on.

Figure 13:
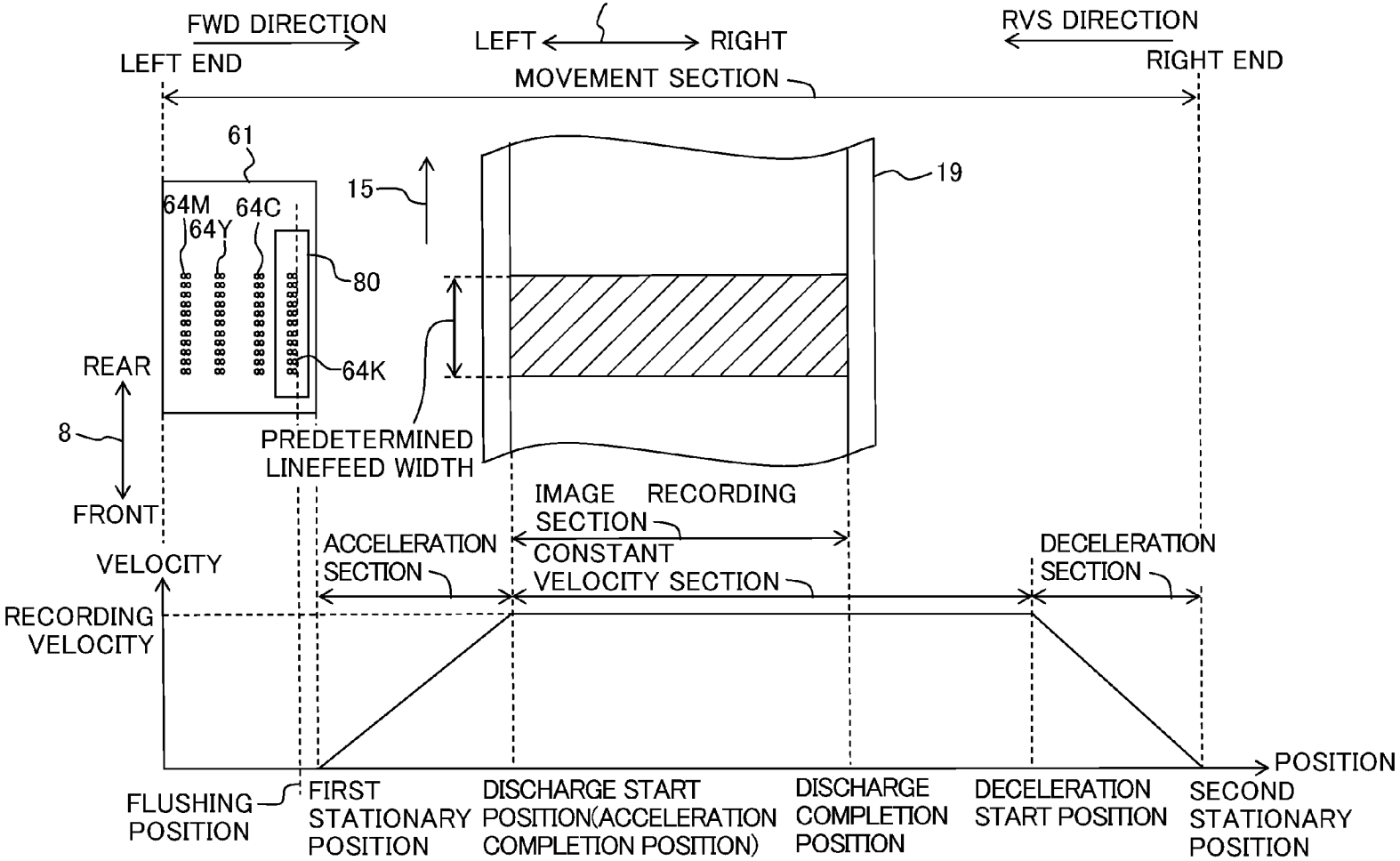
FIG. 13 schematically shows an example of change or transition in the movement velocity of the carriage in the second embodiment.
Figure 14:
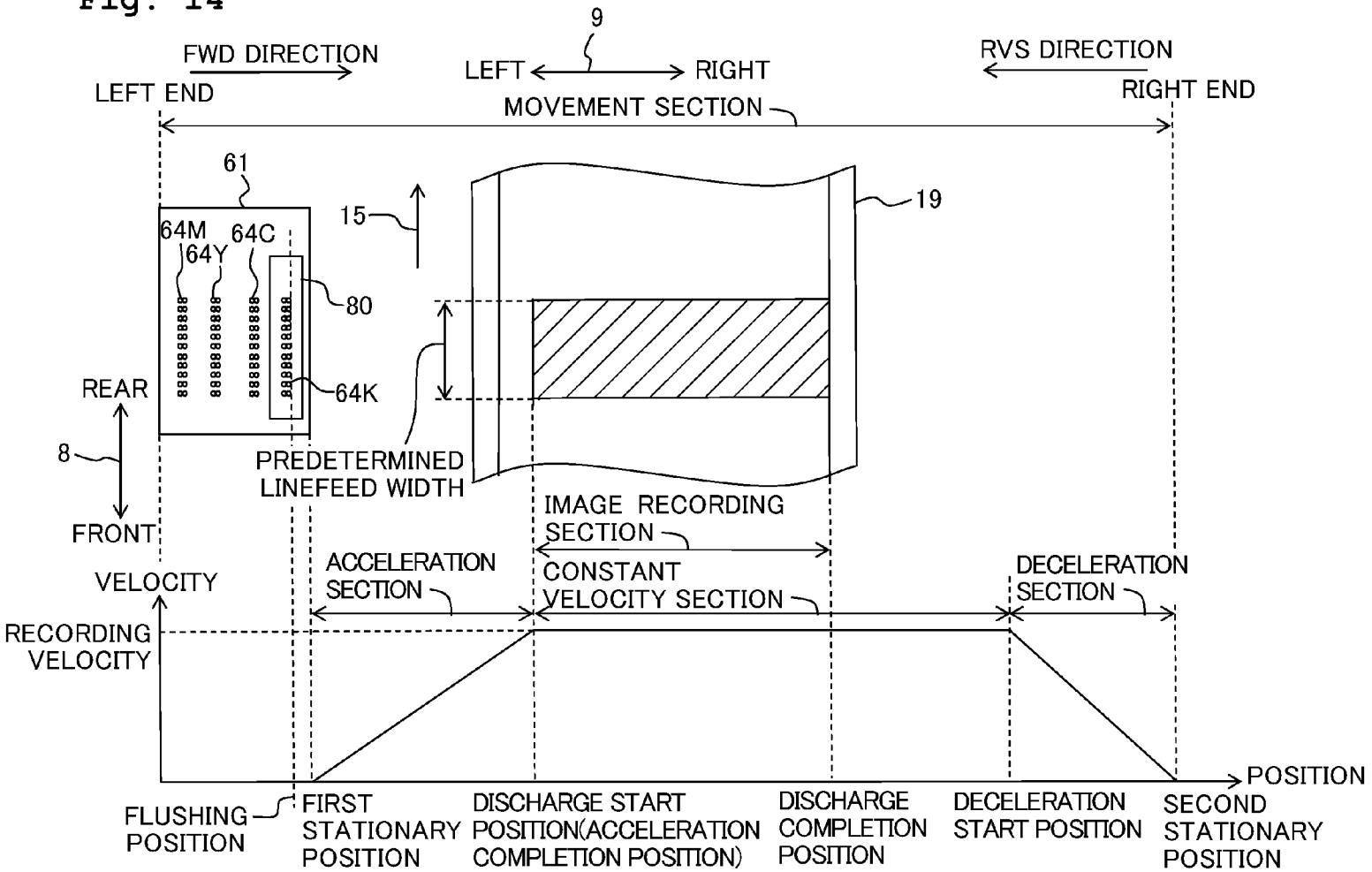
FIG. 14 schematically shows another example of change or transition in the movement velocity of the carriage in the second embodiment.

After the stop process (S38), the controller 130 executes a position obtaining process (S82) in which the discharge start position of each of the nozzle groups 64 in the recording process to be performed next is obtained. The discharge start position is a position, in an area having a predetermined linefeed width in which the image is recorded next, at which the ink is landed first (in other words, a position corresponding to the left end of an area in which the ink is landed when the carriage 61 moves in the FWD direction). Noted that, the discharge start position in the second embodiment varies depending on the area having the predetermined linefeed width in which the image recording is performed. In particular, the discharge start position shown in FIG. 13 is positioned on the left side as compared with the discharge start position shown in FIG. 14. Further, similar to the first embodiment, the discharge start position of the second embodiment may be positioned on the left side of the left end of the recording paper sheet 19.

Subsequently, the controller 130 executes the acceleration determining process in which the acceleration in the acceleration process to be performed next is determined (S83). In particular, the controller 130 determines the acceleration as follows. That is, the discharge start position obtained in the position obtaining process is set as the acceleration completion position, and the movement velocity of the carriage 61 at the acceleration completion position becomes the recording velocity selected in step S81. The acceleration section in the example of FIG. 13 is shorter than the acceleration section in the example of FIG. 14. In other words, the discharge start position in the example of FIG. 13 is closer to the left end of the movement section as compared with the discharge start position in the example of FIG. 14. Therefore, in a case that the recording velocity of the example of FIG. 13 is the same as that of the example of FIG. 14, the acceleration in the example of FIG. 13 is greater than the acceleration in the example of FIG. 14.

In a case that the "ON" is set in any of the flags Bk, C, Y, M (S39: Yes), the controller 130 executes the selecting process shown in FIG. 12 (S84). At first, the controller 130 compares the acceleration determined in step S83 (hereinafter referred to as "acceleration in next pass") with a predetermined first acceleration (an example of a first threshold value) (S91). In a case that the acceleration in next pass is less than the first acceleration (S91: Yes), the controller 130 selects all of the nozzle groups 64K, 64C, 64Y, 64M as the nozzle groups for which the flushing operations are performed in the next flushing process (S92). Further, in a case that the acceleration in next pass is not less than the first acceleration (S91: No), the controller 130 compares the acceleration in next pass with a predetermined second acceleration (an example of a second threshold value) (S93). The second acceleration is greater than the first acceleration. In a case that the acceleration in next pass is less than the second acceleration (S93: Yes), the controller 130 executes the two-color selection process (see FIG. 8A) in which two nozzle groups for which the flushing operations are performed in the subsequent flushing process are selected (S94). In a case that the acceleration in next pass is not less than the second acceleration (S93: No), the controller 130 executes the one-color selecting process (see FIG. 8B) in which one nozzle group for which the flushing operation is performed in the subsequent flushing process is selected (S95).

[Operation and Effect of the Second Embodiment]

According to the second embodiment, a position at which the ink is actually discharged first is defined as the acceleration completion position, and the acceleration is determined in every recording process. In the second embodiment, the number of nozzle groups for which the flushing operations are performed in one flushing process is determined depending on the acceleration determined in the acceleration determining process. That is, the number of nozzle groups selected is decreased in a path having a short acceleration section, and the number of nozzle groups selected is increased in a path having a long acceleration section. Thus, the ink discharged from each of the nozzle groups 64 can be landed in the waste ink tray 80 reliably while maintaining the throughput of the recording process.

[Other Embodiments]

In the flushing timer monitoring process (see FIG. 5) executed by the controller 130 in each of the embodiments, the arrivals of the flushing timings for the four nozzle groups 64K, 64C, 64Y, 64M are monitored by the four timers, respectively. The present teaching, however, is not limited thereto. The arrivals of the flushing timings for the four nozzle groups 64K, 64C, 64Y, 64M may be monitored by one timer. For example, in a case that the flushing operations are performed for two nozzle groups in one flushing process by the controller 130, the controller 130 selects the nozzle groups 64K and 64C in the selecting process immediately after the time-out of the timer (that is, the arrival of the flushing timing) occurs. In the next selecting process, the controller 130 selects the nozzle groups 64Y and 64M. Noted that, the second selecting process in the above case is executed when the carriage 61 in which the first flushing process has been performed stops at the second stationary position. That is, two flushing processes are performed continuously in this case. In a case that the flushing operation is performed for one nozzle group in one flushing process by the controller 130, the flushing operation may be performed every time the carriage 61 moves in the FWD direction in the order of, for example, nozzle groups 64K, 64C, 64Y, 64M.

In each of the embodiments, the explanation is made with respect to the example in which the selecting process is performed while the carriage 61 remains stationary at the second stationary position. The present teaching, however, is not limited thereto. That is, the selecting process can be executed at any timing during a period before the carriage 61 stops at the first stationary position. For example, the selecting process may be performed at a point of time at which the time-out of any of the timers Bk, C, Y, M is detected in the flushing timer monitoring process.

In the two-color selecting process (see FIG. 8A) executed in each of the embodiments, the combination of the nozzle group 64K and nozzle group 64C or the combination of the nozzle group 64Y and nozzle group 64M is selected. The present teaching, however, is not limited thereto. By selecting two nozzle groups adjacent to each other, the flushing operation can be executed for the second nozzle group while the movement velocity of the carriage 61 is slow.

In each of the above embodiments, all of the inks discharged from the nozzle groups 64 may be a pigment. Or, it is allowable that the black ink is the pigment and inks of other colors are dyes. Further, the number of nozzle groups 64 provided in the recording head 62 is not limited to four.

What is claimed is:

1. An ink-jet recording apparatus comprising:

a carriage configured to be movable, within a section between one end and the other end separated in a main scanning direction, in a forward direction from the one end to the other end;

a recording head which is provided in the carriage and has a plurality of nozzle groups aligned in the main scanning direction from which the ink is discharged;

an ink receiver which is provided at a side of the one end including a flushing position and is configured to receive the ink discharged from each of the nozzle groups by a flushing operation in which the ink is discharged irrespective of recording of an image; and a controller configured to control operations of the carriage and the recording head, wherein in a case that the carriage is moved in the forward direction, the controller is configured to execute:

an acceleration process for accelerating the carriage to a recording velocity at which the recording of the image is performed in an acceleration section ranging from a stationary position of the carriage to an acceleration completion position positioned on a downstream of the stationary position in the forward direction;

a selecting process for selecting at least one nozzle group for which the flushing operation is performed from the plurality of nozzle groups so that the number of nozzle groups selected is decreased as an acceleration of the carriage in the acceleration process is increased;

a flushing process for performing the flushing operation for each nozzle group, which is selected in the selecting process, during the acceleration process in a case that each nozzle group arrives at the flushing position; and a recording process for recording the image by discharging the ink from the nozzle groups while the carriage is moved at the recording velocity in a section between the acceleration completion position and the other end.

2. The ink-jet recording apparatus according to claim 1, wherein the nozzle groups include at least four nozzle groups from which inks of different colors are respectively discharged, and in the selecting process, the controller is configured to:

select all of the nozzle groups in a case that the acceleration of the carriage is less than a first acceleration;

select two nozzle groups from the nozzle groups in a case that the acceleration of the carriage is not less than the first acceleration and is less than a second acceleration which is greater than the first acceleration; and select one nozzle group from the nozzle groups in a case that the acceleration of the carriage is not less than the second acceleration.

3. The ink-jet recording apparatus according to claim 2, wherein the controller is configured to execute the selecting process before the carriage moving in a reverse direction opposite to the forward direction is stopped, and the controller is configured to further execute a recovery process for stopping the carriage which is moving in the reverse direction and positioning a nozzle group, of the at least one nozzle group selected in the selecting process, which is positioned on the most upstream side in the reverse direction, at the flushing position.

4. The ink-jet recording apparatus according to claim 3, wherein the recording head includes four nozzle groups aligned in the reverse direction in order of a first nozzle group, a second nozzle group, a third nozzle group, and a fourth nozzle group, the controller is configured to further execute a monitoring process for judging whether a predetermined time has elapsed after the flushing process has been performed, and in a case that two nozzle groups are selected in the selecting process, the controller is configured to:

select the first nozzle group and the second nozzle group in the selecting process immediately after it is judged in the monitoring process that the predetermined time has elapsed; and select the third nozzle group and the fourth nozzle group in the selecting process immediately after the flushing process for each of the first nozzle group and the second nozzle group is executed.

5. The ink-jet recording apparatus according to claim 2, wherein the recording head includes four nozzle groups aligned in a reverse direction opposite to the forward direction in order of a first nozzle group, a second nozzle group, a third nozzle group, and a fourth nozzle group;

the controller is configured to further execute a monitoring process for judging whether a predetermined time has elapsed after the flushing process has been performed, for each of the four nozzle groups separately, and in a case that two nozzle groups are selected in the selecting process, the controller is configured to:

select the first nozzle group and the second nozzle group in a case that it is judged in the monitoring process that the predetermined time has elapsed for the first nozzle group or the second nozzle group; and select the third nozzle group and the fourth nozzle group in a case that it is judged in the monitoring process that the predetermined time has elapsed for the third nozzle group or the fourth nozzle group.

6. The ink-jet recording apparatus according to claim 1, further comprising a storage in which combinations of a plurality of recording velocities and a plurality of accelerations are stored while being correlated with a plurality of pieces of quality information respectively, each of the plurality of pieces of quality information indicating quality of the image to be recorded on the sheet, wherein the recording velocity is increased as quality indicated by quality information, of the plurality of pieces of quality information, which correlate with the recording velocity is lowered, the acceleration is increased as the recording velocity which correlate with the acceleration is increased, the controller is configured to further execute a quality obtaining process for obtaining quality information among the plurality of pieces of quality information, and the controller is configured to:

accelerate the carriage in the accelerating process at an acceleration, of the accelerations stored in the storage, which correlate with the quality information obtained in the quality obtaining process;

move the carriage in the recording process at a recording velocity, of the recording velocities stored in the storage, which correlate with the quality information obtained in the quality obtaining process; and select a smaller number of nozzle groups in the selecting process as quality indicated by the quality information obtained in the quality obtaining process is lowered.

7. The ink-jet recording apparatus according to claim 1, wherein the controller is configured to further execute:

a position obtaining process for obtaining a discharge start position at which the ink is discharged first from the nozzle groups in the recording process; and an acceleration determining process for determining the acceleration of the carriage to reach the recording velocity under a condition that the discharge start position obtained in the position obtaining process is defined as the acceleration completion position, and the controller is configured to select a smaller number of nozzle groups in the selecting process as the acceleration of the carriage determined in the acceleration determining process is increased.

8. The ink jet recording apparatus according to claim 1, wherein the ink discharged from the nozzle groups is a pigment.

* * * * *